US007532098B2

(12) United States Patent
Spurr et al.

(10) Patent No.: US 7,532,098 B2
(45) Date of Patent: May 12, 2009

(54) ACTUATOR

(75) Inventors: Nigel Victor Spurr, Solihull (GB); Gurbinder Singh Kalsi, Oldbury (GB); Sidney Edward Fisher, Redditch (GB)

(73) Assignee: ArvinMeritor Light Vehicle Systems (UK) Limited, West Midlands (GB)

( * ) Notice: Subject to any disclaimer, the term of this patent is extended or adjusted under 35 U.S.C. 154(b) by 251 days.

(21) Appl. No.: 10/518,099

(22) PCT Filed: Jun. 19, 2002

(86) PCT No.: PCT/GB02/02825

§ 371 (c)(1),
(2), (4) Date: Aug. 11, 2005

(87) PCT Pub. No.: WO04/001777

PCT Pub. Date: Dec. 31, 2003

(65) Prior Publication Data

US 2006/0023390 A1 Feb. 2, 2006

(51) Int. Cl.
*H01F 7/00* (2006.01)
*H01F 7/08* (2006.01)

(52) U.S. Cl. ..... 335/229; 335/234; 335/276

(58) Field of Classification Search ..... 335/229–234, 335/276

See application file for complete search history.

(56) References Cited

U.S. PATENT DOCUMENTS

| | | | | |
|---|---|---|---|---|
| 4,128,825 | A * | 12/1978 | Madsen | 335/272 |
| 4,332,450 | A | 6/1982 | Griffith | |
| 4,523,167 | A | 6/1985 | Remington | |
| 4,755,782 | A | 7/1988 | Yamamoto | |
| 5,038,064 | A | 8/1991 | Fiorenza | |
| 5,624,100 | A | 4/1997 | Bolte et al. | |
| 5,632,515 | A | 5/1997 | Dowling | |
| 6,443,635 | B1 | 9/2002 | Matsumoto et al. | |
| 2006/0005591 | A1 | 1/2006 | Belmond | |

FOREIGN PATENT DOCUMENTS

| | | |
|---|---|---|
| DE | 198 06 720 | 8/1998 |
| EP | 0 759 625 | 2/1997 |
| EP | 1083282 | 3/2001 |
| EP | 1329618 | 7/2003 |
| EP | 1615320 | 1/2006 |
| GB | 2339236 | 1/2000 |
| JP | 61102008 | 5/1986 |

(Continued)

OTHER PUBLICATIONS

Japanese Office Action dated Nov. 6, 2007.

(Continued)

*Primary Examiner*—Ramon M Barrera
(74) *Attorney, Agent, or Firm*—Carlson, Gaskey & Olds

(57) ABSTRACT

An actuator includes an electromagnetic coil arrangement that is movable relative to a magnetic field generator between a first position and a second position of the actuator. The actuator is arranged such that when the actuator is in the first position, a pulse of current through the electromagnetic coil arrangement produces a region of magnetic field that repels the magnetic field generator from the first position and attracts the magnetic field generator towards the second position to move the actuator to the second position.

11 Claims, 37 Drawing Sheets

FOREIGN PATENT DOCUMENTS

| | | |
|---|---|---|
| JP | 61111105 | 7/1986 |
| JP | 63164135 | 7/1988 |
| JP | 5504445 | 7/1993 |
| JP | 9199321 | 7/1997 |
| JP | 2000331824 | 11/2000 |
| JP | 2001126922 | 5/2001 |
| WO | WO 99/57397 | 11/1999 |
| WO | 2004/001777 | 12/2003 |

OTHER PUBLICATIONS

International Search Report dated Feb. 17, 2003.

* cited by examiner

HOME POSITION

ENGAGEMENT POSITION

1ST RELEASE POSITION

RESET POSITION

2ND RELEASE POSITION
MECHANICAL RELEASE

ELECTRICAL RELEASE

LOCKED

RELEASED HANDLE
AT REST

HOME POSITION

ENGAGEMENT POSITION

1ST RELEASE POSITION

RESET POSITION

2ND RELEASE POSITION
MECHANICAL RELEASE

ELECTRICAL RELEASE

LOCKED AND HANDLE PULLED

LOCKING MECHANISM
PIN SLIDES IN GUIDE SLOT ON LOCK LINK

ACTUATOR

REFERENCE TO RELATED APPLICATION

This application claims priority to PCT Application PCT/GB02/002825 filed on Jun. 19, 2002.

BACKGROUND OF THE INVENTION

The present invention relates generally to actuators, and in particular to actuators for use in vehicles.

Electric motors are used as actuators for moving components. The electric motors include armature windings and stator windings. The armature is designed to be in a close running fit within the stator to maximize the magnetic field effect.

Linear solenoids are also used as actuators. A current is passed through an electromagnetic coil, which creates a magnetic field to either attract or repulse a magnetic core of the linear solenoid.

As known, the magnetic effect decreases with distance. Therefore, most linear solenoids are designed with as small an air gap as possible. It is also known that linear solenoids can only operate over relatively short distances.

SUMMARY OF THE INVENTION

An object of the present invention is to provide an improved actuator.

The present invention provides an actuator including an electromagnetic coil arrangement that is movable relative to a magnetic field generator between a first position and a second position of the actuator. The actuator is arranged such that, with the actuator in the first position, a pulse of current through the electromagnetic coil arrangement produces a region of magnetic field that repels the magnetic field generator from the first position and attracts the magnetic field generator towards the second position to move the actuator to the second position.

Preferably, the electromagnetic coil arrangement includes a single electromagnetic coil.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
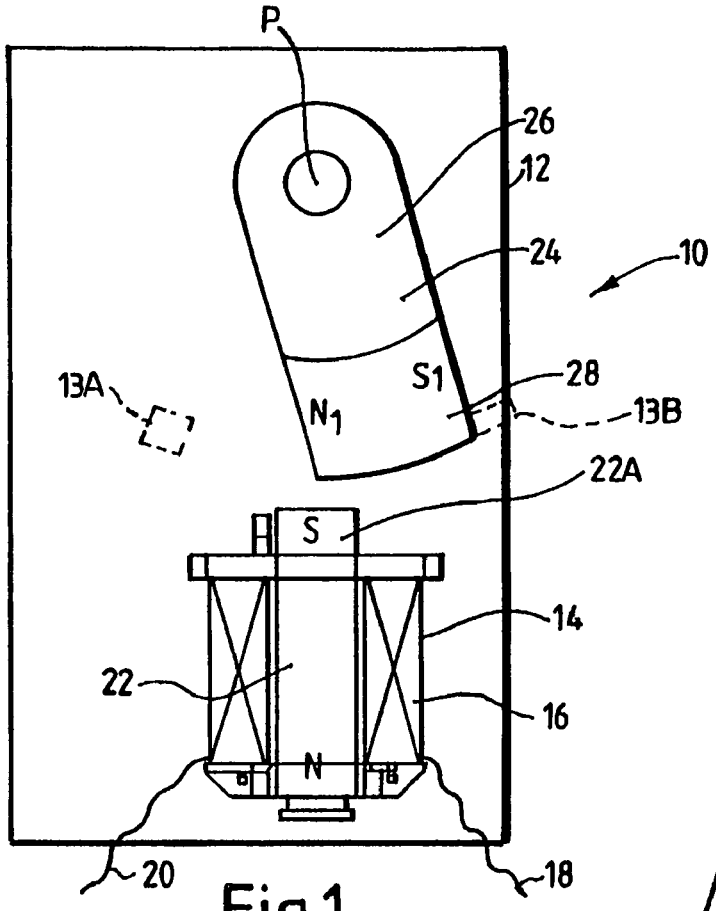
FIGS. 1 and 2 show a first embodiment of an actuator according to the present invention in a first position and a second position.
Figure 2:
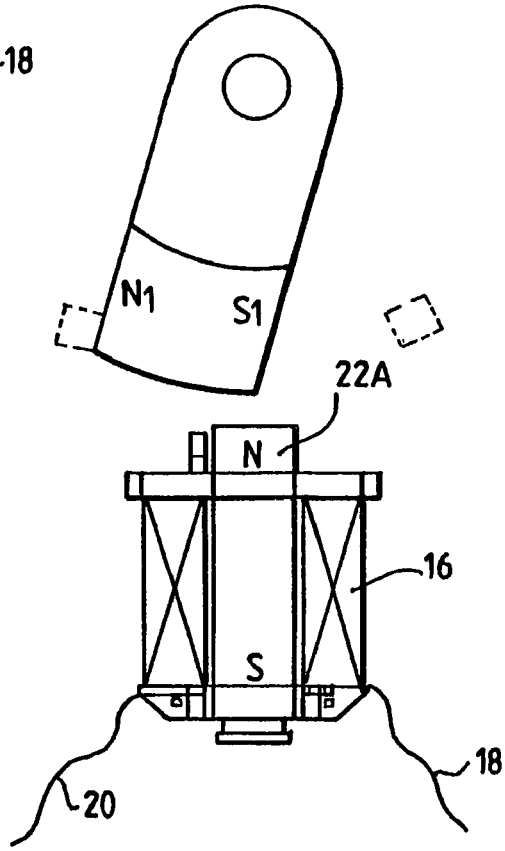

FIGS. 1 and 2 show an actuator 10 having an actuator chassis 12 (only shown in FIG. 1 for clarity) upon which an electromagnetic coil assembly 14 is fixedly mounted on.

The electromagnetic coil assembly 14 includes coil windings 16 connected to power leads 18 and 20. The coil windings 16 form a cylinder within which a core 22 of magnetic material, such as iron, is positioned. The core 22 acts to concentrate the magnetic flux lines.

Passing a current in one direction through the coil winding 16 via the power leads 18 and 20 creates a south pole and a north pole, as indicated in FIG. 1. Reversing the direction of current will reverse the position of the north pole and the south pole.

FIG. 1 also shows a magnetic field generator in the form of a toggle 24 including a mounting portion 26 that is pivotally mounted via a pivot P to the actuator chassis 12. A permanent magnet 28 is secured to an end of the mounting portion 26 that is remote from pivot P. A permanent magnet 28 includes a north pole N1 and a south pole S1.

Operation of the actuator 10 is as follows. When no current is flowing through the coil windings 16, the end 22A of the core 22 is magnetically neutral, i.e., it is neither a north pole nor a south pole. As shown in FIG. 1, the north pole N1 of the permanent magnet 28 is closer to the end 22A than the south pole S1. As such, the predominant magnetic attraction is between the end 22A and the north pole N1, and the toggle 24 remains in a position as shown in FIG. 1.

In order to move the toggle 24 from the position shown in FIG. 1 to a position shown in FIG. 2, current is fed through the core windings 16 to produce a north pole at the end 22A, thus repelling the north pole N1 of the permanent magnet 28 and causing the toggle 24 to pivot clockwise around the pivot P.

As the north pole N 1 moves away from the end 22A, the south pole S1 progressively approaches the end 22A and is therefore progressively attracted to the north pole at the end 22A, further driving the toggle 24 in a clockwise direction until it reaches the position as shown in FIG. 2.

Once in the position shown in FIG. 2, the end 22A again becomes magnetically neutral when the electric current flowing through the coil winding 16 stops, although the toggle 24 remains in the position as shown in FIG. 2 because of the greater magnetic attraction between the south pole S1 and the end 22A.

The toggle 24 can be moved back to the position as shown in FIG. 1 by reversing the current to provide a south pole at the end 22A.

The movement of the toggle 24 is as a result of two sets of forces, namely: a) repulsion force between two similar magnetic poles and b) an attraction force between opposite magnetic poles.

The repulsive force between two similar poles decreases with the distance between the poles. Also, the attractive force between two opposite poles increases as the opposite poles approach each other.

As the pole moves from the position shown in FIG. 1 to the position shown in FIG. 2 and as the repulsive forces between the north pole N1 and the north pole at the end 22A progressively decrease, the attractive forces between the south pole S1 and the north pole at the end 22A progressively increase. This provides for a more uniform force across the range of movement. This can be contrasted with known devices, such as solenoids, wherein either similar poles are used to repel each other or opposite poles are used to attract each other during movement. At no time during the use of known solenoids is an attraction force of opposite poles used in conjunction with repelling forces of similar poles.

Preferably, stops 13A and 13B are provided to limit the rotation of the toggle 24 in a clockwise and counter-clockwise direction, respectively.

Figure 3:
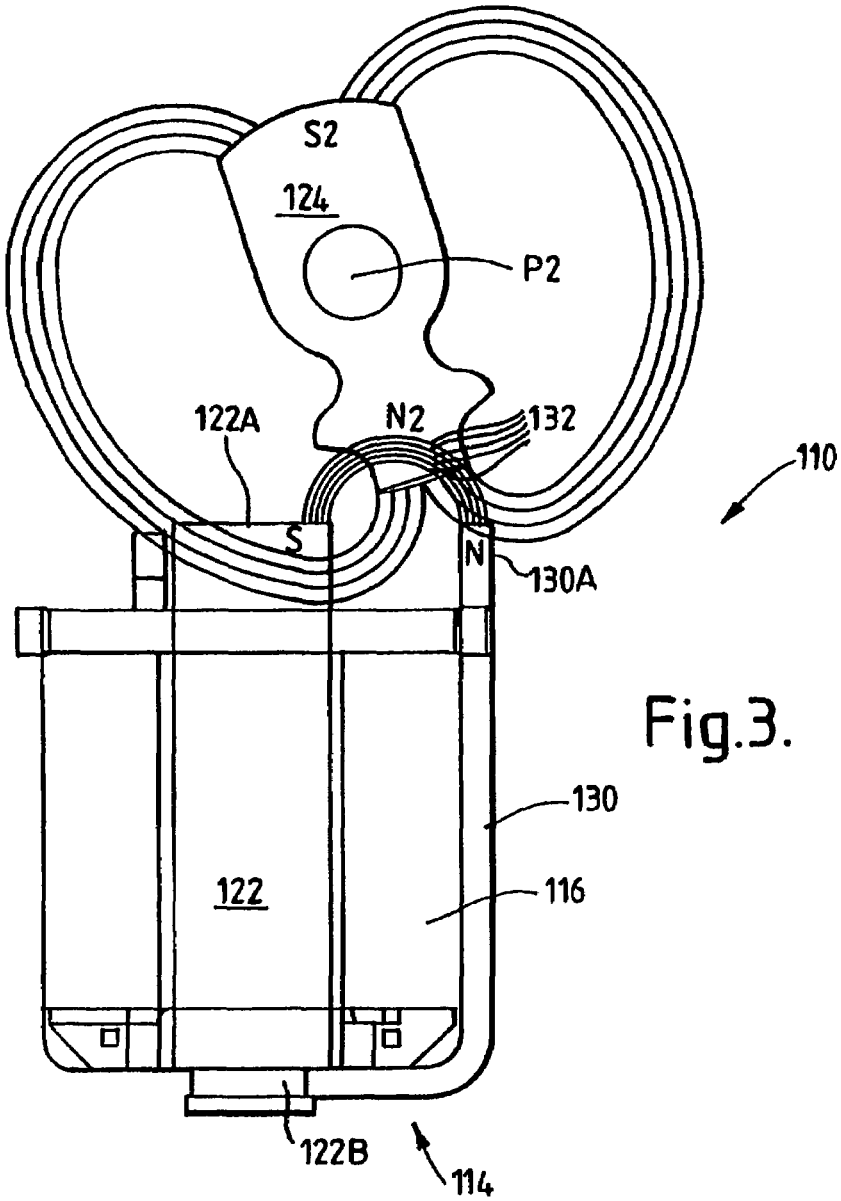
FIGS. 3 and 4 show a second embodiment of the actuator according to the present invention in a first position and a second position.
Figure 4:
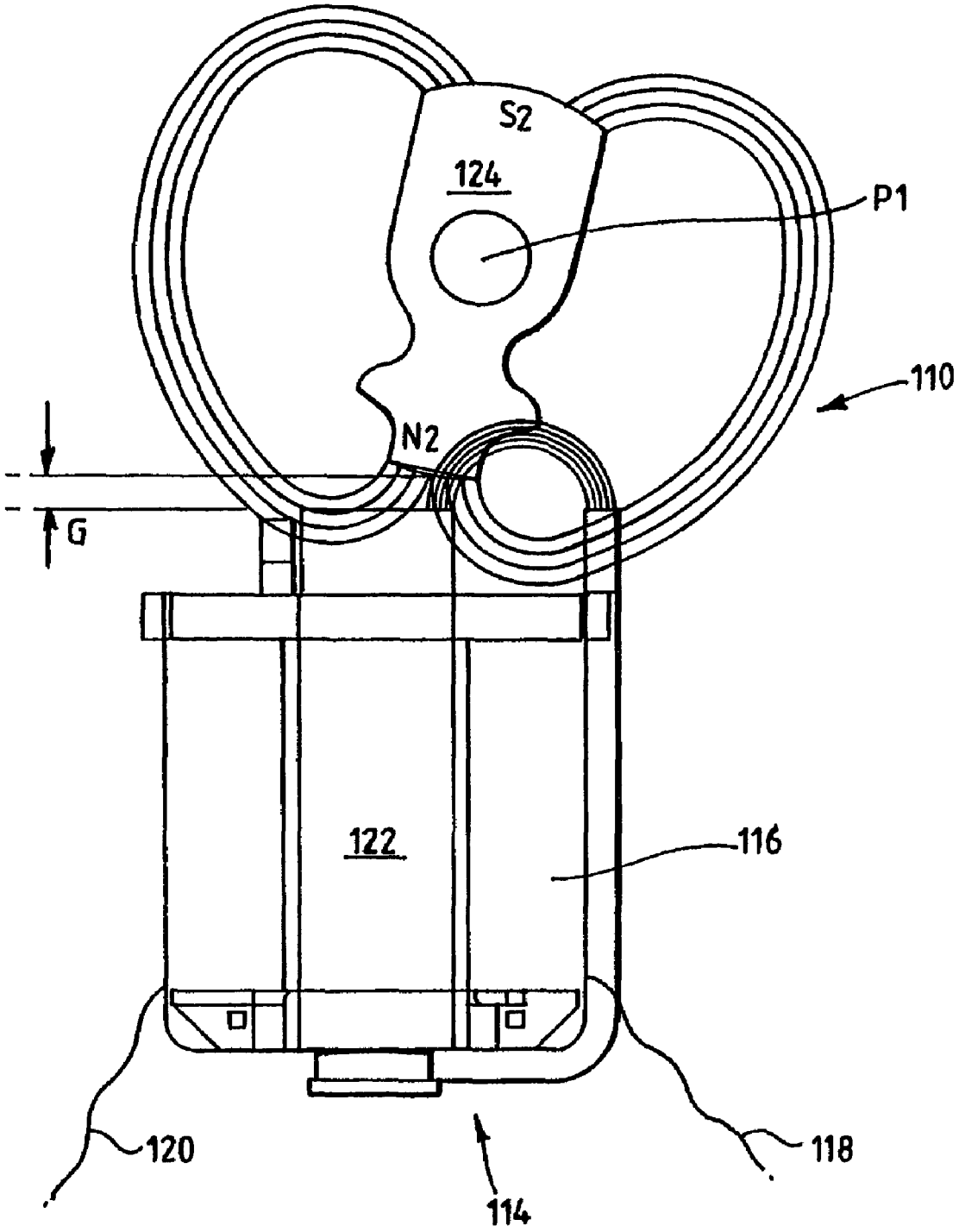

FIGS. 3 and 4 show a further embodiment of an actuator 110, with components similar to those of the actuator 10 being labelled 100 greater.

In this case, the electromagnetic coil assembly 114 includes a frame 130, which is connected to an end 122B of a core 122 and passes outside coil windings 116.

An end 130A of the frame 130 is positioned at the same end of the coil windings 116, but is spaced from the end 122A. The frame 130 is made of a magnetic material, such as iron or steel, and acts to concentrate the magnetic flux lines, i.e., it acts as a conduit for the magnetic flux lines.

Figure 3A:
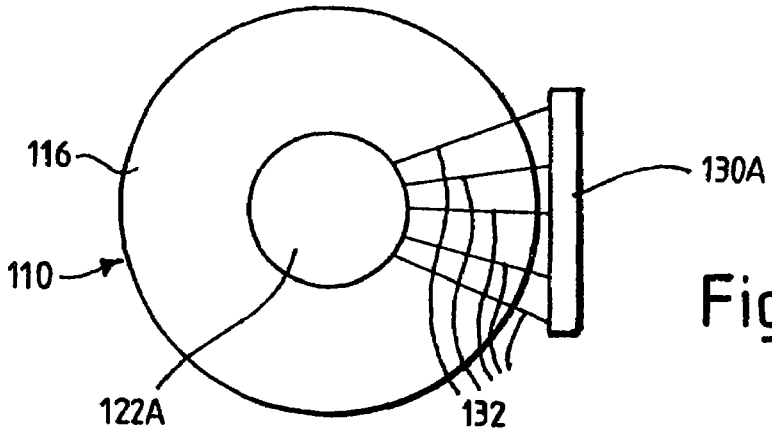
FIG. 3A shows an end view of a coil of FIG. 3.

In particular, with reference to FIG. 3A, the end 130A does not completely encircle the coil windings 116, but is positioned only on one side of the coil windings 116 in a sector.

When current is fed to the coil windings 116 in one direction, a south magnetic pole is generated at the end 122A of the core 122. Because of the frame 130, the north pole that would normally be expected to be produced at the end 122B is transferred to the end 130A of the frame 130. In particular, the core 122 and the frame 130 concentrate the magnetic flux lines. However, there is an "air gap" between the ends 130A and 122A that the magnetic flux has to jump. The magnetic flux lines in the air gap are shown as lines 132.

It can be seen, especially from FIG. 3A, that the magnetic flux lines 132 are concentrated in a sector of the coil winding 116 as they pass from the end 130A to the end 122A.

Consideration of the toggle 124 shows that the permanent north pole N2 and the permanent south pole S2 are situated at opposite ends of the toggle 124 on either side of a pivot P2, with the north pole N2 being situated proximate to the electromagnetic coil.

Operation of the actuator 110 is as follows. Current is fed through the coil windings 116 to produce a north pole at the end 130A and a south pole at the end 122A. This causes the permanent north pole N2 to be repelled from the north pole at the end 130A and simultaneously attracted towards the south pole at the end 122A, thus causing the toggle 124 to pivot clockwise to the position shown in FIG. 4.

The toggle 124 can be moved back to the position shown in FIG. 3 by reversing the current through the coil winding 116 such that a north pole is provided at the end 122A and a south pole is provided at the end 130A.

Figure 4A:
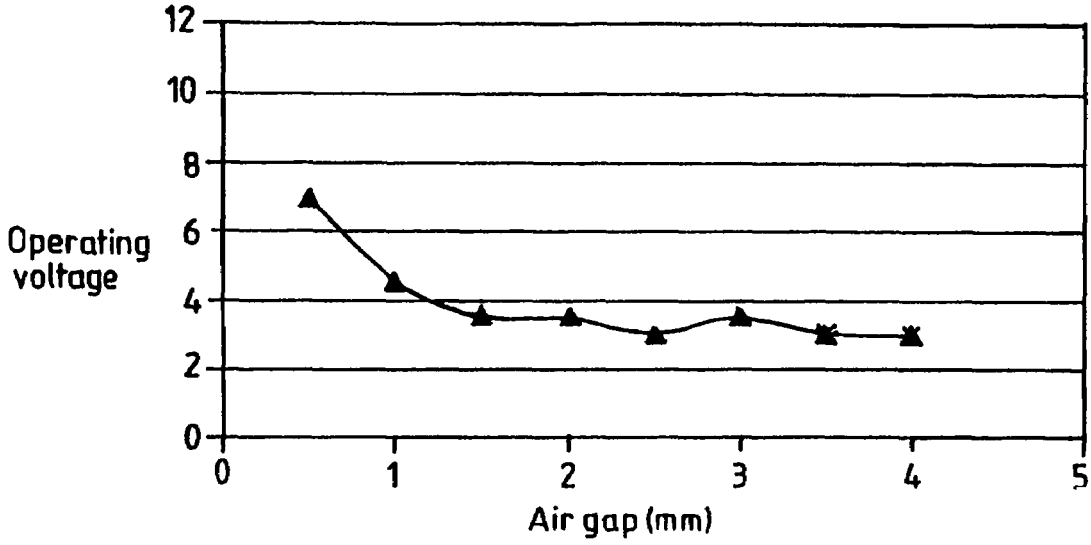
FIG. 4A shows the results of tests carried out on the actuator of FIG. 3.

Experiments were carried out on a sample actuator 110 to optimize the position of the toggle 124 relative to the electromagnetic coil assembly 114. Thus, the position of a pivot P1 was adjusted to vary a gap G. A voltage was applied across power leads 118 and 120 and was increased until the toggle 124 moved from one position to the other position. The results are shown in FIG. 4A and surprisingly, with a small gap G of 0.5 mm, approximately 7 volts was required to move the toggle 124. However, as the air gap progressively increased, a lower voltage was required to actuate the device. Thus, with an air gap of 1.0 mm, approximately 4.5 volts was required, and with an air gap of 1.5 mm, approximately 3.5 volts was required.

This was a surprising result since it is generally accepted that magnetic devices operate best, and hence require lower power, with small air gaps.

This is best understood by considering the fact that magnetic flux cannot easily turn through sharp corners. Thus, FIG. 3 shows that the magnetic flux lines 132 pass in an arc between the end 130A and the end 122A. Where the magnetic flux lines 132 cross the flux lines emitted by the permanent magnet, the toggle 124 will easily move. However, when the gap is too small, it is harder to move the toggle 124 since the magnetic flux lines 132 pass through the permanent magnet rather than across the magnetic field.

In a further embodiment, the single electromagnetic coil assembly 114 could be replaced by a pair of electromagnetic coils positioned adjacent one another and wired in series such that the north pole N2 can be simultaneously repelled from a north pole of one magnetic coil and attracted to a south pole of the adjacent magnetic coil.

Figure 5:
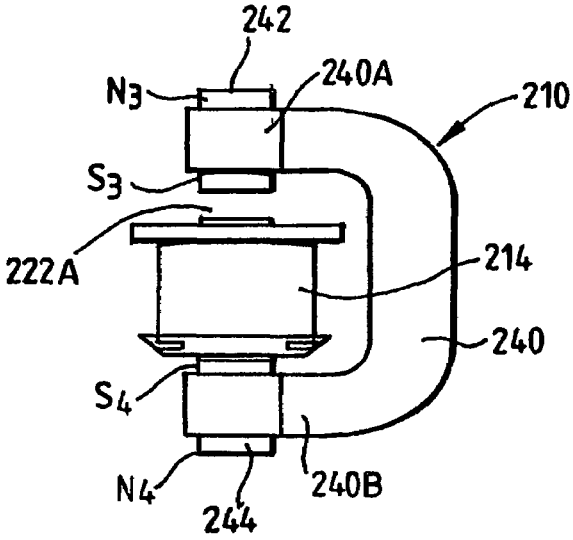
FIGS. 5 and 6 show a third embodiment of the actuator according to the present invention in a first position and a second position.

FIG. 5 shows a further embodiment of an actuator 210, which includes an electromagnetic coil assembly 214 fitted to a chassis (not shown) of the actuator 210. A yoke 240 is made of a non-magnetic material, such as a plastics material. A first permanent magnet 242 is mounted in an end 240A of the yoke 240, and a second permanent magnet 244 is mounted in an end 240B of the yoke 240.

Figure 6:
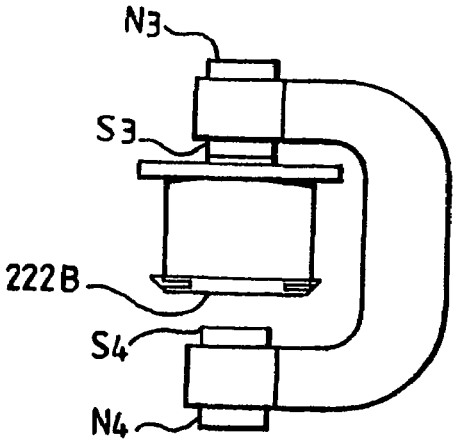

A south pole S3 of the permanent magnet 242 faces a south pole S4 of a permanent magnet 244. The coil assembly 214 is situated between the south poles S3 and S4. The yoke 240 and the permanent magnets 242 and 244 are moveable via sliders (not shown) between the positions shown in FIG. 5 and FIG. 6. Starting at the position shown in FIG. 5, a current is passed through the coil assembly 214 in a first direction, and a north pole is created at the end 222A of the core, and a south pole is created at the end 222B, causing the yoke 240 to move to the position as shown in FIG. 6.

Reversing the current through the coil assembly 214 will reverse the magnetic poles, causing the yoke 240 to move back to the position as shown in FIG. 5. The ends 22A and 22B act as stops to limit the downward and upward movement of the yolk 240.

The actuators of the present invention can be used in many fields, in particular on vehicles such as cars and to provide security functions. It is therefore preferable that they are capable of functioning on cars which have a "12 volt" system. Thus, preferably the actuators can be used with an operating voltage of 14 volts (alternator output voltage), 12 volts (battery voltage) or 8 volts (partially drained battery). Similarly, where the actuators are used on vehicles with a "24 volt" system, it is preferable for them to operate at 28 volts, 24 volts and 16 volts, respectively. Where the actuators are used on vehicles with a "42 volt" system, it is preferable for them to operate at 49 volts, 42 volts and 28 volts, respectively.

In all embodiments described so far, the electromagnetic coil assembly is fixed relative to the chassis of the actuator, and the magnetic field generator (permanent magnet) is caused to move. Preferably, this allows the power leads to the electromagnetic coil assembly to remain stationary. However, in further embodiments and under certain installations, it may be preferable for the permanent magnets to remain stationary and to allow the electromagnetic coil assembly to move.

Furthermore, the magnetic field generator has thus far only been shown to include a permanent magnet. In further embodiments, the permanent magnet could be replaced by a further electromagnetic coil.

In further embodiments, the electromagnetic coil assembly 214 could be replaced by a permanent magnet, and the permanent magnets 242 and 244 can be replaced by electromagnetic coils wired in series such that one of the electromagnetic coils is attracted towards the adjacent magnet, while the other of the electromagnetic coils is repelled from the adjacent magnet.

Figure 7:
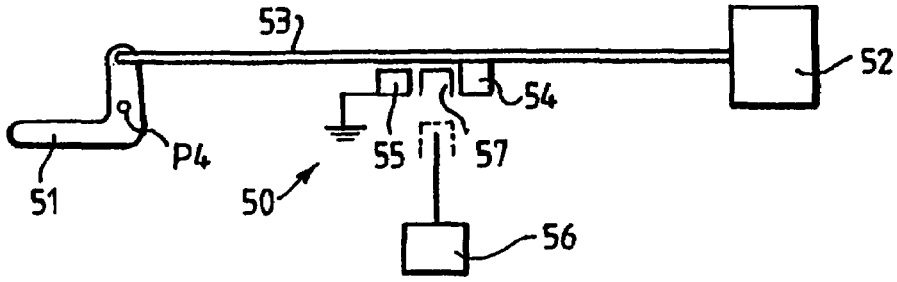
FIG. 7 shows a schematic view of the actuator according to the present invention used to provide for block locking.

FIG. 7 shows a schematic view of a latch arrangement 50 including a door handle 51 connected to a door latch 52 via a rod 53. The door handle 51 is actuated by pivoting it about pivot a P4 to cause the rod 53 to move to the left and unlatch the latch 52, allowing an associated door (not shown) to be opened.

The rod 53 carries an abutment 54 situated proximate to a further abutment 55 mounted on the door. An actuator 56 according to the present invention carries an actuator abutment 57 which, by operation of the actuator, can be inserted into a space between the abutments 55 and 54, thus preventing unlatching of the latch 52 by blocking movement of the rod 53 and hence locking the door. The actuator 56 can be operated to withdraw the actuator abutment 57 to the position shown in dotted outline, thus allowing the abutment 54 to move to the left upon operation of the door handle 51, thus unlocking the door. In a further preferred embodiment, the actuator 56 and associated components required for locking can be situated within a latch housing of the latch 52.

Figure 8:
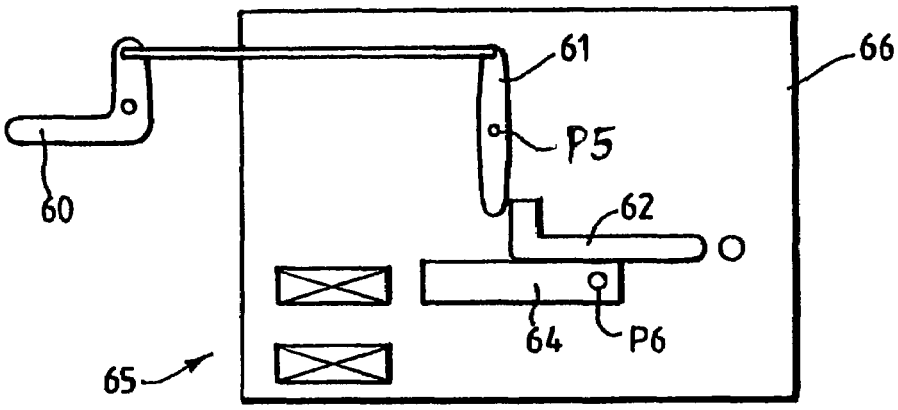
FIGS. 8 and 9 show a schematic view of the actuator according to the present invention used to provide for free-wheel locking.
Figure 9:
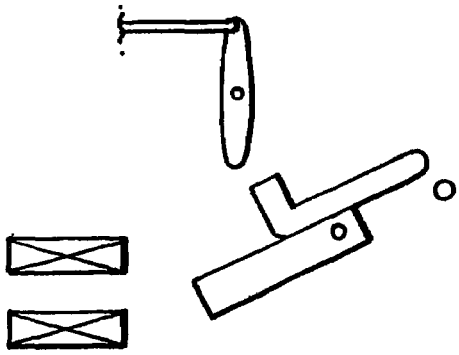

FIGS. 8 and 9 show a schematic view of a "free wheel" type of locking system situated within a latch housing 66. Operation of a door handle 60 causes a lever 61 to pivot counter-clockwise about a pivot P5, causing a slider 62 to move to the right and push a pawl lifter 63 to the right, thus releasing the latch 52.

The slider 62 is slidingly mounted on a toggle 64 of an actuator 65 according to the present invention. The toggle 64 pivots about a pivot P6. Actuation of the actuator 65 causes the toggle 64 to move to the position as shown in FIG. 9 such that actuation of the inside door handle 60 moves the lever 61 such that it bypasses the slider 62 and does not cause release of the latch 52. FIG. 8 shows the system in an unlocked condition, and FIG. 9 shows the system in a locked condition.

Where the handle 51 or 60 is an inside handle, the system provides for a child safety and/or superlocking (or deadlocking) function in conjunction with a lockable outside handle.

Figure 10:
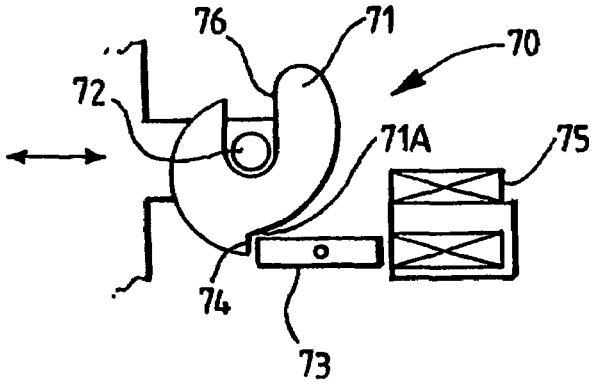
FIG. 10 shows a schematic view of the actuator according to the present invention used to provide for power unlatching.

FIG. 10 shows a door latch 70 including a rotating latch bolt in the form of a claw 71. A striker 72 can be retained in the position as shown in FIG. 10 by virtue of a toggle 73 that acts as a claw pawl against a claw abutment 74. Actuation of an actuator 75 according to the present invention causes the toggle 73 to rotate counter-clockwise about a pivot P7, thus releasing the claw 71 which can then rotate counter-clockwise to allow the striker 72 to be withdrawn from a claw mouth 76. Stops can be provided to limit the clockwise and counter-clockwise rotation of the toggle 73. In particular, an edge 71A of the claw 71 can be used to limit clockwise rotation of the toggle 73.

Figure 11:
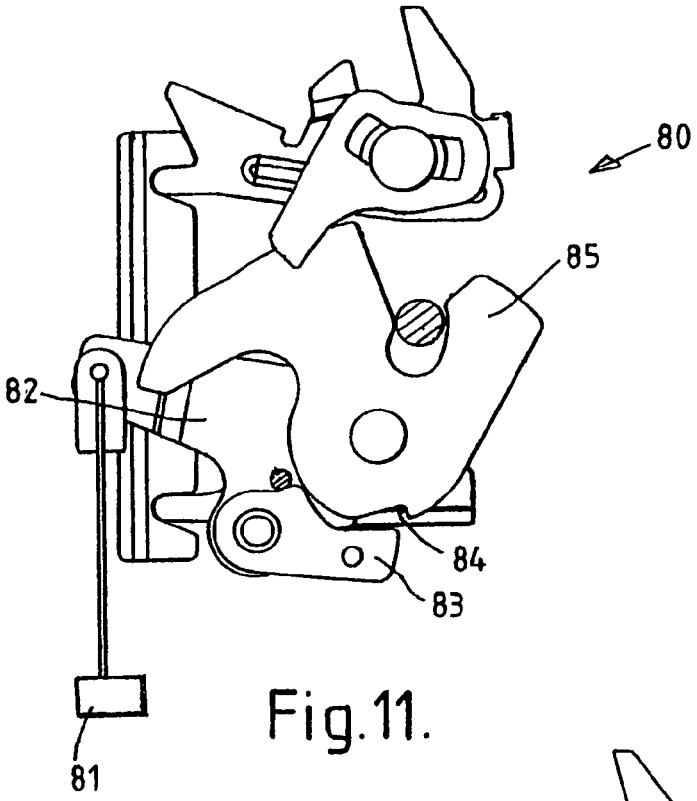
FIGS. 11 and 12 show a schematic view of the actuator according to the present invention used to provide for power latching.
Figure 12:
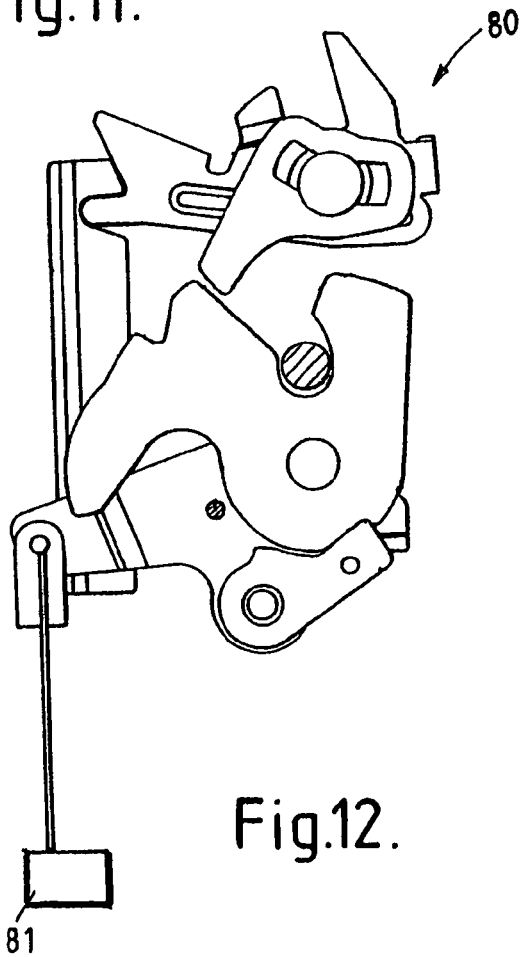

FIGS. 11 and 12 show a latch arrangement as described in the applicant's earlier granted Great Britain patent number GB2328242. The Great Britain patent provides a full explanation of the operation of a latch 80. However, in summary, the latch 80 is a power latching latch, i.e., a latch in which an actuator 81 moves a lever 82 in a counter-clockwise direction such that a pawl 83 engages in a notch 84 of a claw 85, driving the claw 85 to the position as shown in FIG. 12 when the door has been closed and the latch is in the position shown in FIG. 11. In this case, the actuator 81 is an actuator according to the present invention.

The actuator of the present invention may also be used to open a fuel filler flap by mounting the flap (not shown) to the toggle 24 and 124. Alternatively, the actuator may be used to unlatch a flap that is resiliently biased towards an open position, for example.

Figure 13:
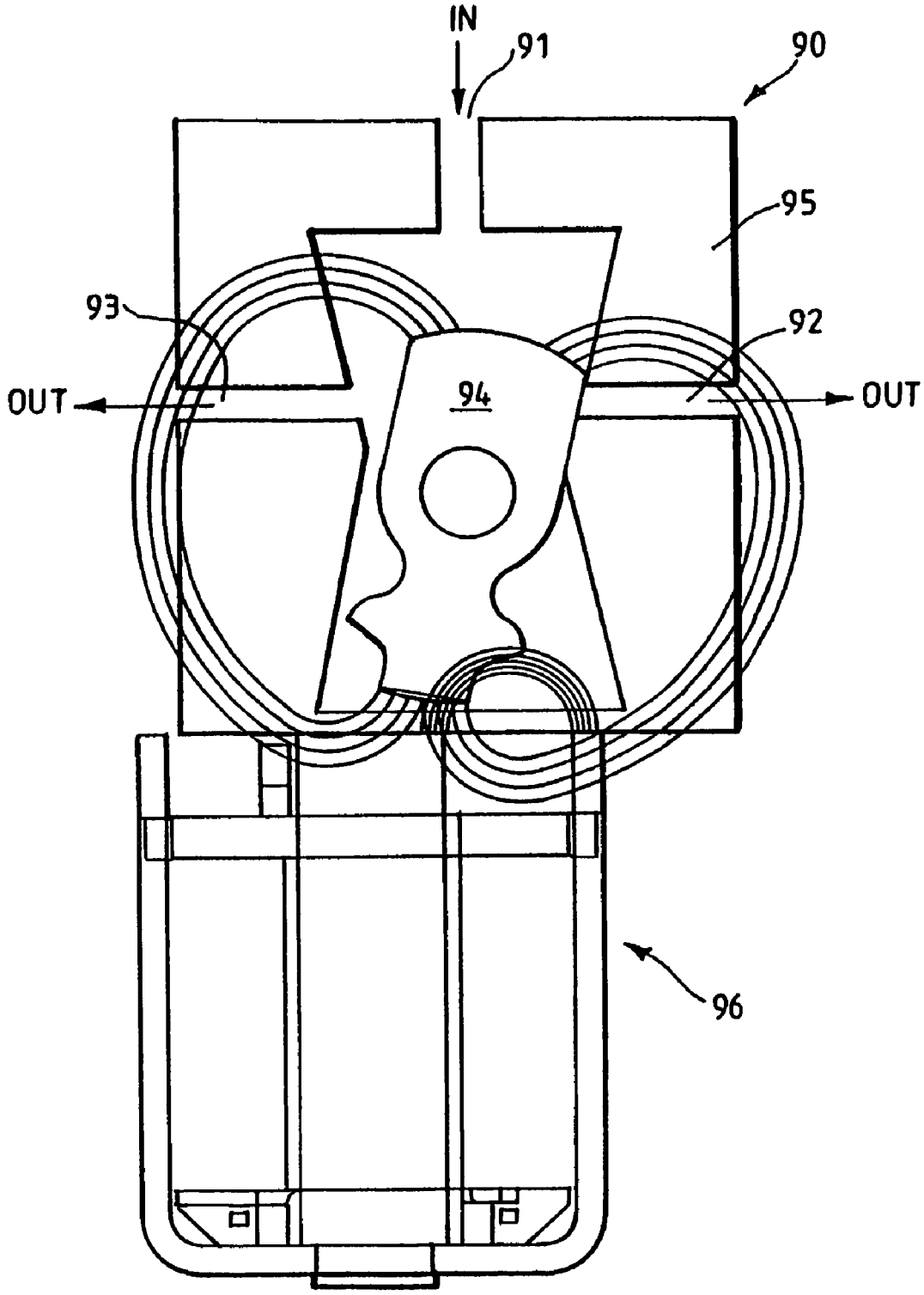
FIG. 13 shows a valve incorporating the actuator according to the present invention.

FIG. 13 shows a valve 90 having an inlet 91 and alternate outlets 92 and 93. The toggle 94 sits within a valve body 95 and selectively blocks the outlet 92 or outlet 93. As shown in FIG. 13, liquid or gas pumped through inlet 91 will exit via the outlet 93. Actuation of the actuator 96 will cause the toggle 94 to rotate counter-clockwise, blocking the outlet 93 and opening the outlet 92. The portions of the valve body 95 act as stops to limit the clockwise and counter-clockwise rotation of the toggle 94.

Figure 14:
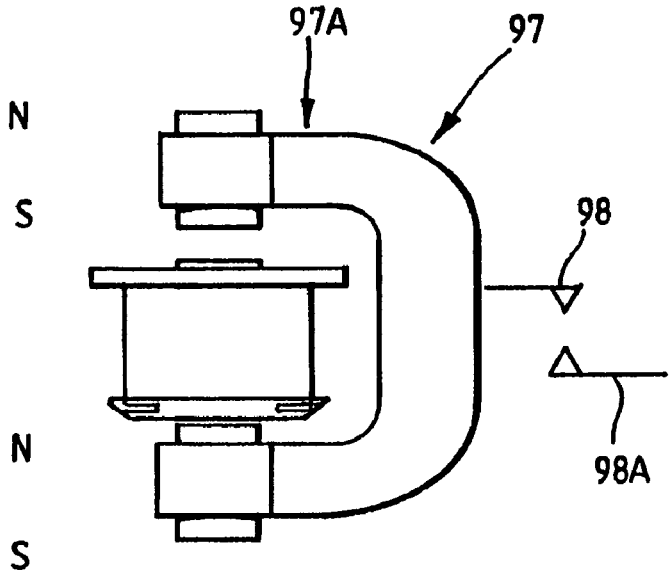
FIGS. 14 and 15 show a schematic view of a relay incorporating the actuator according to the present invention.
Figure 15:
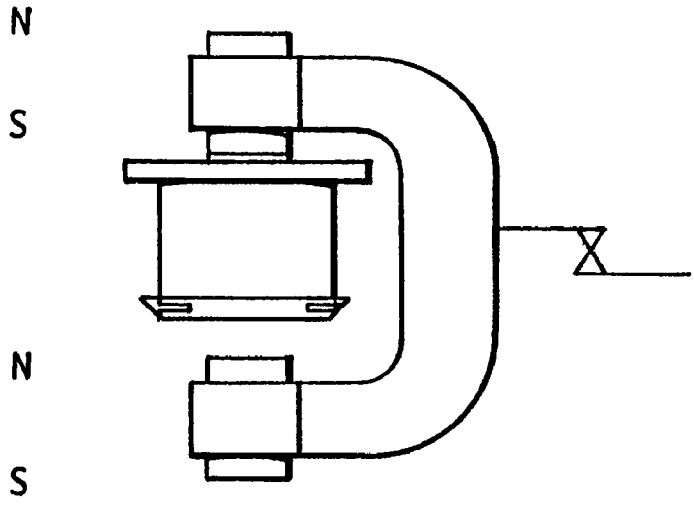

FIGS. 14 and 15 show a relay 97 having an actuator 97A according to the present invention that is attached to a relay contact 98. A further relay contact 98A is mounted on the body of the relay 97, and the relay contact 98 can be opened or closed by actuation of the actuator 97A.

There now follows a description of an embodiment of an actuator according to the present invention used as part of a latch arrangement. The present invention can be used in latch arrangements, and in particular latch arrangements for use within doors of cars (automobiles).

Known car doors include latches for releasably retaining the car door in a closed position. Such latches can be locked when the car is left unattended or even when an occupant is in the vehicle to prevent access to the vehicle by unauthorized people.

These latches can be moved between a locked condition and an unlocked condition either by manual means, such as by operating an inside sill button or an exterior key barrel, or can be powered between the locked condition and the unlocked condition by a power actuator which can be controlled remotely by, for example, infrared devices.

A problem with power locking/unlocking is that it may not be possible to change the state of the lock in the event of a power loss e.g., during a road traffic accident or because of a flat battery. Thus, where a vehicle is in use, the doors are locked and the vehicle is involved in a road traffic accident, the occupant of the vehicle may be locked in the vehicle immediately following the crash, which clearly has safety implications. Furthermore the power actuator is expensive to produce and manufacture.

Thus, in one form of the invention, latch arrangement includes a latch, a release mechanism, a manually actuable element and a control means including an actuator. The latch is operable to releasably retain a striker in use. The release mechanism is capable of being moved by the manually actuable element from a rest position through an unlocked position to a release position wherein it unlatches the latch. The control means has a locked condition at which actuation of the manually actuable element does not cause unlatching of the latch and an unlocked condition at which the release mechanism achieves the unlocked position during an initial movement of the manually actuable element. During subsequent movement of the manually actuable element, the release mechanism achieves the unlatch position.

Preferably, movement of a door handle provides two functions: namely unlocking the latch mechanism and releasing the latch mechanism. Furthermore, the control means can be configured to ensure the latch arrangement remains in a locked condition independent of actuation of any door handles (inside or outside doors) when necessary.

Preferably, the release mechanism includes a release link having an abutment operable to move a latch release element. Preferably, when the control means is in the locked position, actuation of the manually actuable element moves the abutment, but the abutment does not move the latch release element. Preferably, the abutment is mis-aligned with the release element in the rest condition. Preferably, the release link is operably movable by a release lever.

Preferably, a part of the release mechanism is retained in a rest position by the control means to provide for the lock condition. Preferably, the part of the release mechanism is retained by magnetic attraction or by a control pawl. Preferably, the part of the release mechanism is a lock/unlock lever which is retained in a first position when the control means is in a locked condition and is allowed to move to a second position when the control means is in an unlocked condition.

Preferably, the lock/unlock lever is connected to the release link by a connector. Preferably, the lock/unlock lever, the connector and the release link substantially move in unison during the initial movement of the manually actuable element. Preferably, the lock/unlock lever, the connector and the release link rotate about a pivot during the initial movement. Preferably, the pivot mounts the lock/unlock lever on a chassis of the latch arrangement.

Preferably, the lock/unlock lever remains stationary during subsequent movement of the manually actuable element. Preferably, the release mechanism is designed to return to the rest position from the release position upon release of the manually actuable element.

Preferably, the release mechanism is biased to the rest position by a resilient member. Preferably, a first resilient member biases the release mechanism to the unlocked position from the released position, and a second resilient member biases the release mechanism to the rest position from the unlock position. Preferably, the latch is further movable between a latched position and a released position by a powered released actuator. Preferably, the control means is movable between the locked condition and the unlocked condition by manual operation of a coded security device, such as a key.

The figures show a latch arrangement 410 having a latch 412 (only part of which is shown), a release mechanism 416, a powered control means (actuator) 418, a manually actuable elements in the form of an inside handle 420 and an outside handle 421.

The latch 412 is mounted on a car door and is operable to releasably retain a striker mounted on fixed structure of the car, such as a B post or a C post. The latch 412 typically might include a latch bolt in the form of a rotating claw which engages the striker. To ensure the claw retains the striker, a pawl can be provided to retain the latch bolt in a closed position. The pawl includes a latch release element in the form of a pawl pin 414.

Figure 16:
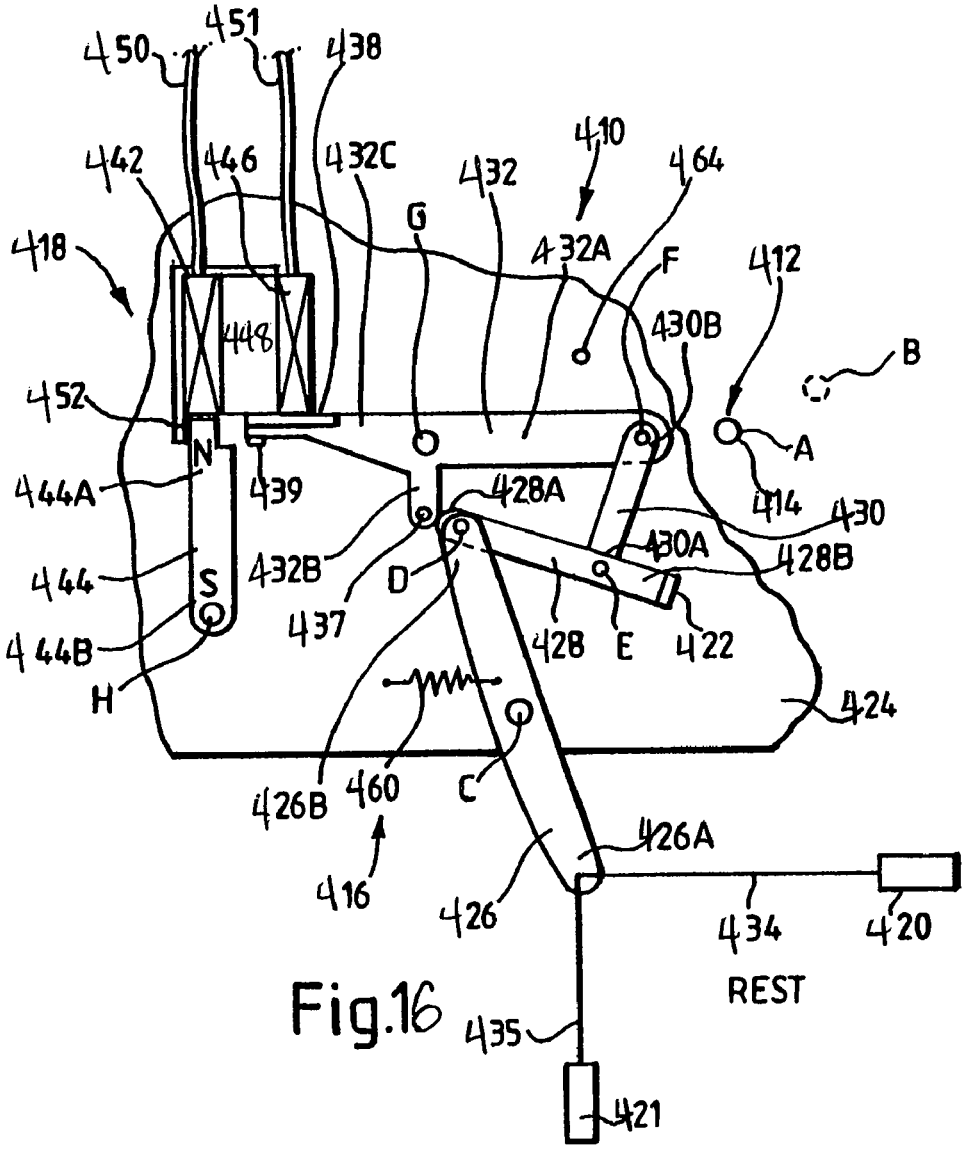
FIG. 16 is a view of a latch arrangement according to another form of the present invention.

With the pawl pin 414 in a position A as shown in FIG. 16, closing of the door causes the rotating claw to engage the striker, and the pawl will then retain the striker in the closed position. Movement of the pawl pin 414 to the position B, as shown in FIG. 16, will release the pawl from engagement with the claw, thus allowing the striker to be released from the claw and allowing the door to open. Thus, with the pawl pin 414 in the position A of FIG. 16, the latch 412 can be latched to the striker, and with the pawl pin 414 in the position B of FIG. 16, the latch 412 can be unlatched from the striker.

The release mechanism includes a release lever 426, a release link 428, a connector link 430 and a lock/unlock lever 432. The release lever 426 is pivotally mounted about a pivot C on a chassis 424 of the latch arrangement 410. One end 426A of release lever 426 is connected via a linkage 434 (shown schematically) to a manually actuable element in the form of the inside handle 420.

The end 426A is further connected by a further linkage 435 (shown schematically) to a further manually actuable element in the form of the outside door handle 421. Operation of either the handle 420 or 421 causes the release lever 426 to rotate clockwise about the pivot C. The end 426B of the release lever 426 is connected via a pivot D to the end 428A of the release link 428. The end 428B of the release link 428 includes an abutment 422 for engagement with the pawl pin 414, as will be further described below.

The release link 428 is connected to an end 430A of the connector link 430 by a pivot E which is positioned between the ends 428A and 428B. The end 430B of the connector 430 is connected to an end of the arm 432A of the lock/unlock lever 432 by a pivot F.

The lock/unlock lever 432 further includes arm 432B having a pin 437 and an arm 432C having abutment 438 and 439. The lock/unlock lever 432 is pivotally mounted about a pivot G onto the chassis 424.

The lock/unlock lever 432 is made from mild steel, and in particular the abutment 438 is made from a ferromagnetic material. However, in further embodiments other materials can be used (see below).

The actuator according to the present invention is provided in the form of the powered control means 418 which includes an electromagnet 442 and a magnetic pawl (toggle) 444.

The electromagnet 442 is mounted on the chassis 424 and includes windings 446, a core 448 and electric leads 450 and 451. A pawl stop 452 is provided on one side of the electromagnet 442 and is made of magnetic material (such as iron or steel) and thus acts as part of a frame, one end of which is connected to the core 448.

The magnetic pawl 444 includes a permanent magnet and is pivotally mounted about a pivot H onto the chassis 424. The end 444A of the magnetic pawl 444 includes abutments 454, 456 and 458, which will be further described below.

A tension spring 460 is connected to the chassis 424 and the release lever 426 and acts to bias the release lever 426 in a counter-clockwise direction when viewing FIG. 16. A further tension spring 462 (only shown in FIG. 18 for clarity) biases the pin 437 and the pivot D together.

In further embodiments, different forms of springs can be used, in particular torsion springs (clock springs) in place of tension springs 460 and 462, to perform the same biasing action. The lock/unlock lever stop 464 is mounted on the chassis 424.

As a result of the tension spring 462, the end 428A of the release link 428 is biased into engagement with the pin 437. In further embodiments, the end of the release lever 426 could engage the pin 437, as could a part of the pivot D.

The magnetic pawl 444 has a south pole at an end 444B and a north pole at an end 444A. Applying DC current to the windings 446 via the electric leads 450 and 451 in a first direction will create a magnetic field around the electromagnet which will bias the north pole in the end 444A of the magnetic pawl 444 to the left when viewing FIG. 1 i.e., counter-clockwise about the pivot H until the abutment 454 engages the pawl stop 452.

Figure 16A:
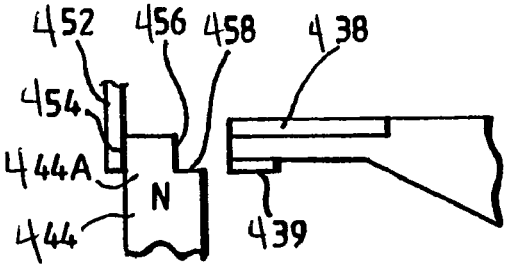
FIG. 16A is an enlarged view of part of FIG. 16.
Figure 16B:
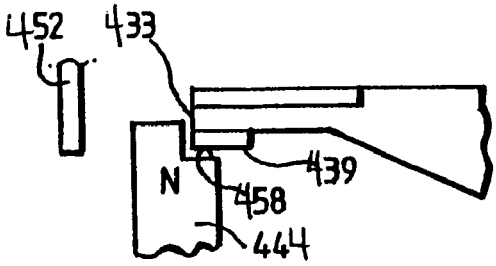
FIG. 16B is a view similar to FIG. 16A with a magnetic pawl in a different position.

Applying DC current in a second direction to the windings 446 via the electric leads 450 and 451 will cause a different magnetic field to form around the electromagnet such that the north pole end 444A of the magnetic pawl 444 is biased to the right when viewing FIG. 1 i.e., clockwise around the pivot H until the abutment 456 engages the end 433 of the arm 432C of the lock/unlock lever 432 (see FIG. 16B). Under these conditions, the abutment 458 is opposite the abutment 439 and will prevent rotation of the lock/unlock lever 432 counter-clockwise about the pivot G (see below).

To move the magnetic pawl 444 between the positions shown in FIGS. 16A and 16B, it is only necessary to apply a short pulse (e. g., 50 ms) of current to the windings 446 in the appropriate direction, since under normal circumstances once the magnetic pawl 444 has achieved one of the positions as shown in FIGS. 16A or 16B, there are no forces which tend to move the magnetic pawl 444 out of those positions.

In a preferred embodiment, the center of gravity of the magnetic pawl 444 is substantially located at the pivot H since, in the event of a road traffic accident, the arrangement will not tend to rotate the magnetic pawl 444 because of acceleration or deceleration occurring during the accident.

In a further preferred embodiment, a relatively light detent maintains the magnetic pawl 444 in either of the positions as shown in FIG. 16A and FIG. 16B, which can nevertheless be overcome by manual operation of a key or by pulsing the electromagnet.

Counter-clockwise rotation of the lock/unlock lever 432 about the pivot G can be prevented by applying and maintaining DC current in the first direction to the windings 446 since the abutment 438 is made from a ferromagnetic material and will therefore be magnetically attracted to electromagnet 442.

The powered control means 418 has three conditions. In a first condition, no power is applied to the windings 446, and the magnetic pawl 444 is in the position as shown in FIG. 16B. In a second condition, power is supplied and maintained in a first direction to the windings 446, thus attracting the abutment 438 and ensuring that the magnetic pawl 444 is positioned as shown in FIGS. 16 and 16A. In a third condition, no power is supplied to the windings 446 and the magnetic pawl 444 is in position as shown in FIG. 16, and the permanent North magnetic pole is attracted to the magnetic material of the pawl stop 452.

Operation of the latch arrangement is as follows. With the powered control means 418 in the third condition, the door can be manually opened as follows. As mentioned previously, with the powered control means 418 in the third condition, the magnetic pawl 444 is positioned as shown in FIG. 16 and thus does not restrict rotation of the lock/unlock lever 432 in a counter-clockwise direction.

Furthermore, no power is supplied to the windings 446, and thus the electromagnet 442 also does not restrict movement of the lock/unlock lever 432 in a counter-clockwise direction.

Figure 17:
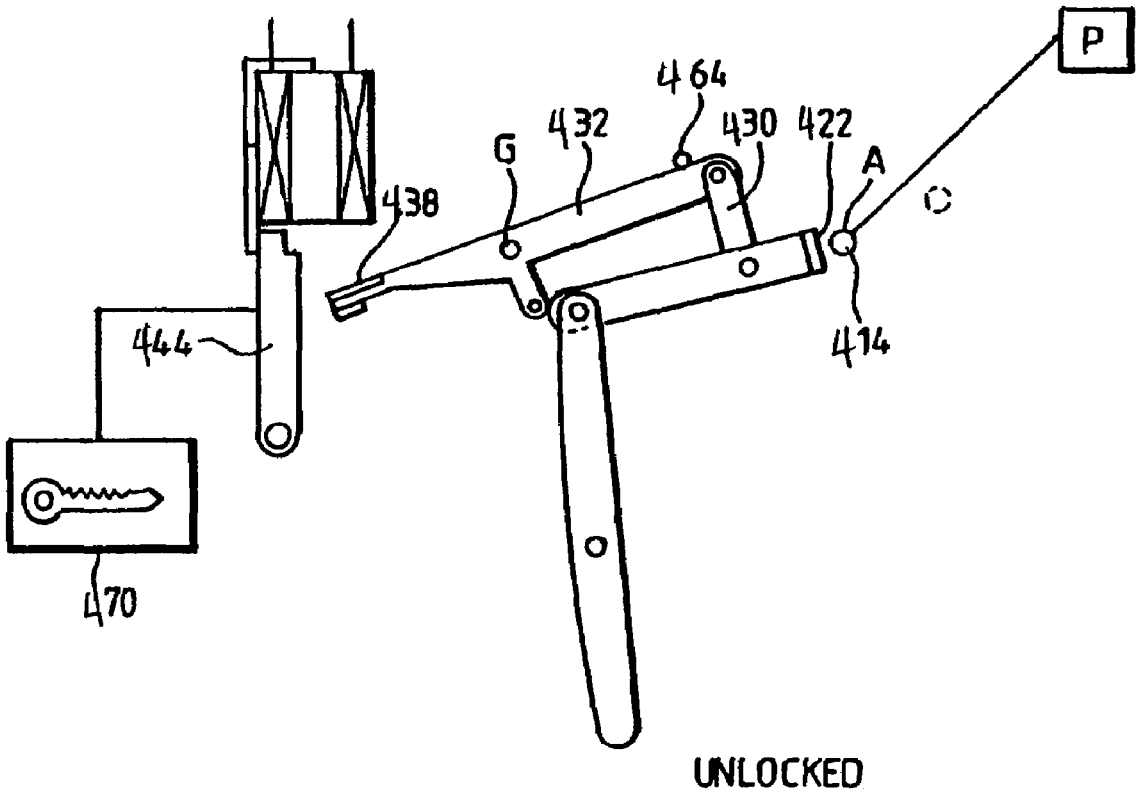
FIG. 17 shows the latch arrangement of FIG. 16 partially through an opening operation in an unlocked but latched position.

Initial movement of either the inside handle 420 or the outside handle 421 moves the release lever 426 in a clockwise direction about the pivot C to the unlocked position, as shown in FIG. 17.

The lock/unlock lever 432 has rotated counter-clockwise about the pivot G to a position where the arm 432A abuts the lock/unlock lever stop 464. The abutment 438 has become disengaged from the electromagnet 442.

FIG. 17 shows that the end 428A of the release link 428 has remained in contact with the pin 437. Thus, the connector link 430 and the release link 428 have also substantially rotated about the pivot G. As shown in FIG. 17, the abutment 422 aligns with the pawl pin 414. This can be contrasted with the position of the abutment 422, as shown in FIG. 16, where it is not aligned with the pawl pin 414.

Figure 18:
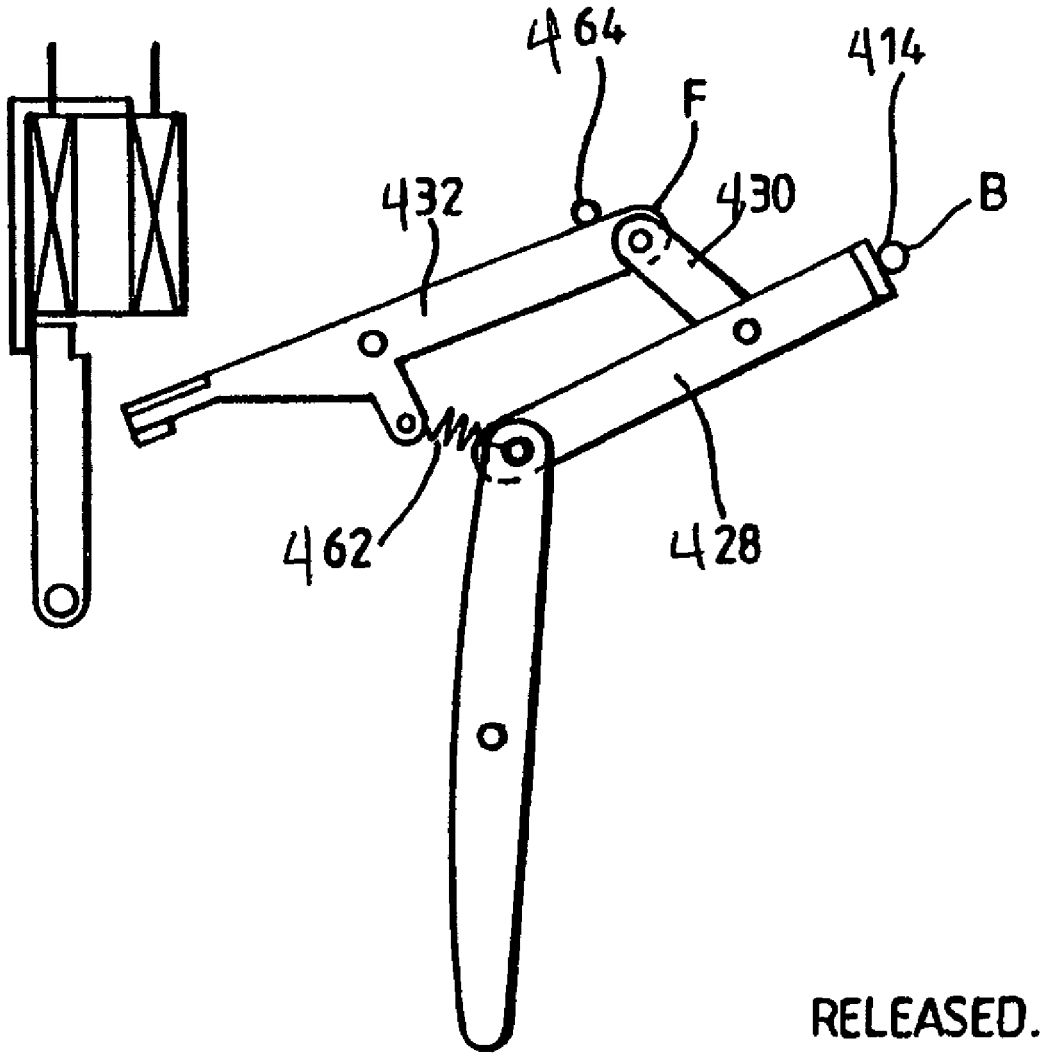
FIG. 18 shows the latch arrangement of FIG. 16 at the end of an opening operation in an unlatch condition.

Further movement of the inside door handle 420 or the outside door handle 421 moves the release lever 426 from the position as shown in FIG. 17 to the position as shown in FIG. 18.

In view of the fact that the arm 432A of the lock/unlock lever 432 is in abutting engagement with the lock/unlock lever stop 464, the lock/unlock lever 432 cannot rotate further in a counter-clockwise direction. Thus, the connector link 430 rotates counter-clockwise about the pivot F relative to the lock/unlock lever 432. The abutment 422 of release link 428 moves into engagement with the pawl pin 414 and moves it from position A as shown in FIG. 17 to position B as shown in FIG. 18. As previously mentioned, movement of the pawl pin 414 from the position A to the position B unlocks the latch.

When the inside door handle 420 and the outside door handle 421 are released, the spring 460 and the spring 462 return the release mechanism 416 and the pawl pin 414 to the position as shown in FIG. 16.

While the movement of the inside door handle 420 or the outside door handle 421, and hence movement of the release lever 426, has been described in two stages, such two stage movement is not discernible by a person operating the door handles 420 and 421. Furthermore, the mechanism is designed to move seamlessly from the position as shown in FIG. 18 to the position as shown in FIG. 16.

With the control means in the second condition i.e., DC current supplied to the windings 446 in the first direction and the magnetic pawl 444 is in a position as shown in FIG. 16, the lock/unlock lever 432 is maintained in the position as shown in FIG. 16 by magnetic attraction.

Figure 19:
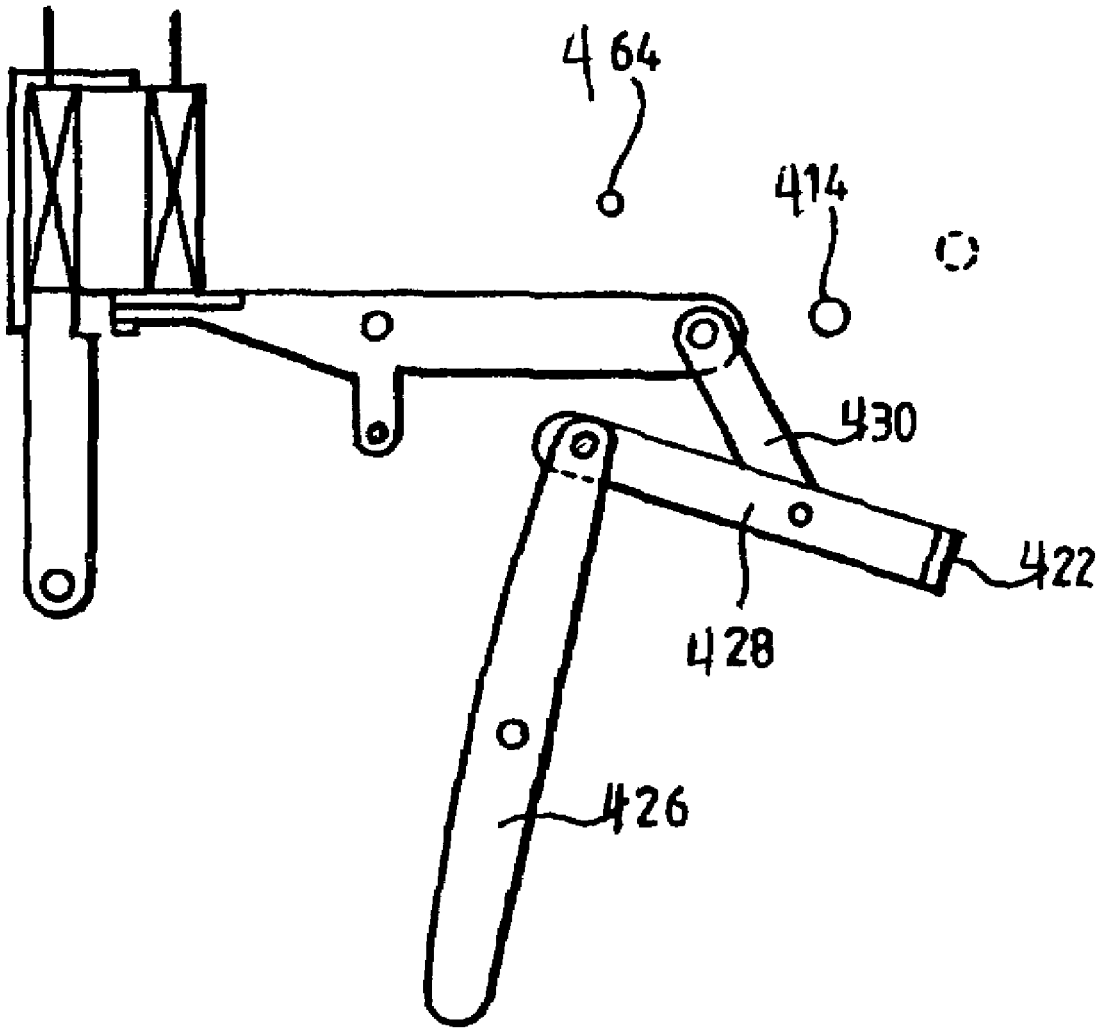
FIG. 19 shows the latch arrangement of FIG. 16 wherein an attempt has been made to open the latch while in a locked condition.

Thus, operation of the inside door handle 420 or the outside door handle 421 will cause the release lever 426 to rotate in a clockwise direction as shown in FIG. 16, which will result in the end 428A of the release link 428 from immediately disengaging the pin 437 such that the release lever 426, the release link 428 and the connector link 430 move to the position as shown in FIG. 19.

While the abutment 422 is moved, such movement causes the abutment 422 to bypass the pawl pin 414 and to not impart any movement to the pawl pin 414 in view of the fact that it was initially mis-aligned with the pawl pin 414. Thus, while the inside door handle 421 or the outside door handle 420 has been moved, the door has not become unlatched. In further embodiments, it is possible to arrange an abutment (such as the abutment 422) to be permanently aligned with a latch release element (such as the pawl pin 414 but remote therefrom) such that with the latch arrangement 410 in a locked condition, the abutment 422 approaches the pawl pin 414 but does not move it. With the latch arrangement 410 in an unlocked condition, the abutment 422 approaches, engages and then moves the pawl pin 414.

With the control means in the second condition, the door latch remains in a locked condition.

With the control means in the first condition i.e., where no power is provided to the windings 446 but the magnetic pawl 444 is in a position as shown in FIG. 1B, counter-clockwise rotation of the lock/unlock lever 432 is again prevented, though this time by cooperation of the abutments 439 and 458. Thus, actuation of the inside door handle 421 or the outside door handle 420 will again cause the release lever 426, the release link 428 and the connector link 430 to move to the position as shown in FIG. 19.

FIG. 17 shows schematically a power actuator P which is independently operable to release the latch.

Further shown schematically is a coded security device 470 in the form of an externally mounted key barrel into which a key can be inserted. Actuation of the key barrel via the key is capable of moving the magnetic pawl 444 between the positions shown in FIGS. 16A and 16B.

The latch arrangement is configured such that when the associated vehicle is in use, the control means is set to the second condition i.e., power is maintained to the windings 446. Under such circumstances, electric power lost to resistance in the windings 46 can be compensated for by the fact that the engine of the vehicle is running and hence the battery recharging system (such as an alternator) can recharge the battery to ensure it does not go flat.

When the vehicle is parked and left unattended, the control means can be set to the first condition to lock the latch. The control system does not drain the vehicle battery in the first condition.

The control mechanism can also be set to the third condition when the vehicle is parked and is required to be in an unlocked condition. In the third condition, there is no drain on the battery.

The control means can be changed between the first condition and the third condition by applying a pulse of electrical power to the windings 446 in an appropriate direction.

With the vehicle in use and the control means in the second condition, as mentioned above, the lock/unlock lever 432 is maintained in the position as shown in FIG. 16 by feeding power to the electromagnet. In the event of a power failure, such as might occur following a road traffic accident, the control means will by definition change to the third condition and hence the doors will become unlocked and occupants of the vehicle will be able to escape from the vehicle.

With the vehicle parked and with the control means in the first condition i.e., with the vehicle locked, pulsing of the electromagnet to move the control means from the first condition and the third condition to unlock the vehicle will not be possible in the event that the vehicle battery is flattened, perhaps as a result of an interior light being left on. However, it is nevertheless possible to manually unlock the vehicle by use of the key and the key barrel 470. The key and the key barrel 470 can also be used to lock the vehicle, if necessary.

Power is continually fed to the windings 446 only when the vehicle is in use. When the vehicle is parked, power is only momentarily fed to the windings 446 to change between the locked condition and the unlocked condition.

This arrangement significantly reduces the chance of flattening the battery when the vehicle is parked, but still allows the doors to be opened in the event of a power loss following a road traffic accident.

The electromagnet 442 needs to only be strong enough to retain the lock/unlock lever 432 in the position shown in FIG. 16 when the electromagnet 442 is in the second condition i.e., when power is being supplied to the electromagnet 442. Thus, the electromagnet 442 has to be strong enough to overcome the forces in tension spring 460 during initial movement of the inside handle 421 or the outside handle 420, and it has to overcome the forces in tension spring 460 and 462 during a subsequent movement of the inside handle 421 or the outside handle 420. The electromagnet 442 is not required to be strong enough to move the lock/unlock lever 432 from the position as shown in FIG. 17 to a position such that the abutment 438 engages the electromagnet 442.

The powered control means 418 has two ways of preventing rotation of the lock/unlock lever 432, namely by permanently energizing of the windings 446 or by moving the magnetic pawl 444 to the position as shown in FIG. 16B. In further embodiments, in particular when no power release P is provided, the control means can be used to simply lock and unlock the vehicle e.g., when parked. As such, it is only necessary for the windings 446 to be pulsed to move the magnetic between the positions as shown in FIG. 16A and FIG. 16B. As such, the electromagnet 442 is not required to attract the lock/unlock lever 432, which can therefore be made of a non ferromagnetic material, such as a plastics material. Under these circumstances, it is necessary to have a manual override system operable by the inside handle 421 (but not the outside handle 420) such that when the inside handle 421 is moved, the magnetic pawl 444, if in the position as shown in FIG. 16B, is moved to the position as shown in FIG. 16A. Once the magnetic pawl 444 is in the position as shown in FIG. 16A, the latch release mechanism 416 can then operate in its two stage manner i.e., aligning the abutment 422 with the magnetic pawl 444 followed by moving the magnetic pawl 444 from position A to position B, as shown in FIG. 16, to open the latch. Under such an arrangement, it is preferable that the release mechanism 416 fully returns to the rest position upon release of the inside handle 421 i.e., the abutment 422 becomes mis-aligned with the pawl pin 414.

There now follows a description of an embodiment of an actuator according to the present invention used as part of a latch arrangement, and in particular latch arrangements used within doors of cars.

The invention provides a latch arrangement including a latch, a manually actuable element, a release mechanism and a power control means including an actuator. The latch is operable to releasably retain a striker in use, and the release mechanism is capable of being moved by the manually actuable element from a latched position to an unlatched position wherein it unlatches the latch. The power control means has a first condition, a second condition and a third condition.

With the power control means in the first condition, the control means is in a non-powered condition and actuation of the manually actuable element does not cause the release mechanism to unlatch the latch. With the power control means in the second condition, the powered control means is in a powered condition and actuation of the manually actuable element does not cause the release mechanism to unlatch the latch. With the power control means in the third condition, the power control means is in a non-powered condition and actuation of the manually actuable element causes the release mechanism to unlatch the latch.

Preferably, a part of the release mechanism is retained in a locked position by the control means to provide for a lock condition of the latch. Preferably, the part of the release mechanism is retained by magnetic attractionor by a pawl. Preferably, the part of the release mechanism is a lock/unlock lever which is retained in the first position by the control means to provide for the lock condition and is allowed to move to a second position to provide for the unlocked condition.

Preferably, the control means includes an electromagnet to retain the part of the release mechanism in the unlocked position. Preferably, the electromagnet is incapable of moving the part of the release mechanism from the unlocked position to the locked position. Preferably, the control means includes a magnetic pawl movable between a locked position and an unlocked position. Preferably, the electromagnet is pulsed to move the pawl between the locked position and the unlocked position. Preferably, the pawl is pivotally movable, and the center of gravity of the pawl is substantially at the axis of the pivot.

Preferably, the release mechanism is designed to return to the rest position from the release position upon release of the manually actuable element. Preferably, the release mechanism is biased to the rest position by a resilient member.

Preferably, a first resilient member biases the release mechanism to the unlocked position from the released position, and a second resilient member biases the release mechanism to the rest position from the unlock position.

Preferably, unlatching of the latch arrangement causes the release mechanism to move to a locked condition. Preferably, the release mechanism can be retained in the locked condition while the latch is in the unlatched condition. Preferably, the release mechanism is retained in the locked condition by putting the control means into the first condition. Preferably, the release mechanism is retained in the locked condition by putting the control means into the second condition.

Preferably, the latch is further movable between a latched position and a released position by a powered released actuator. Preferably, the control means is movable between the locked condition and the unlocked conditions by manual operation of a coded security device, such as a key.

FIGS. 20, 20A, 20B, 20C and 20D show a further embodiment of a latch arrangement 310 having components which fulfill substantially the same function as those components in the latch arrangement labelled 300 greater. Again, the actuator according to the present invention is provided in the form of a powered control means 318. A pawl stop 352 is provided on one side of an electromagnet 342 and is made of a magnetic material (such as iron or steel) and thus acts as part of a frame, one end of which is connected to a core 348.

Figure 20:
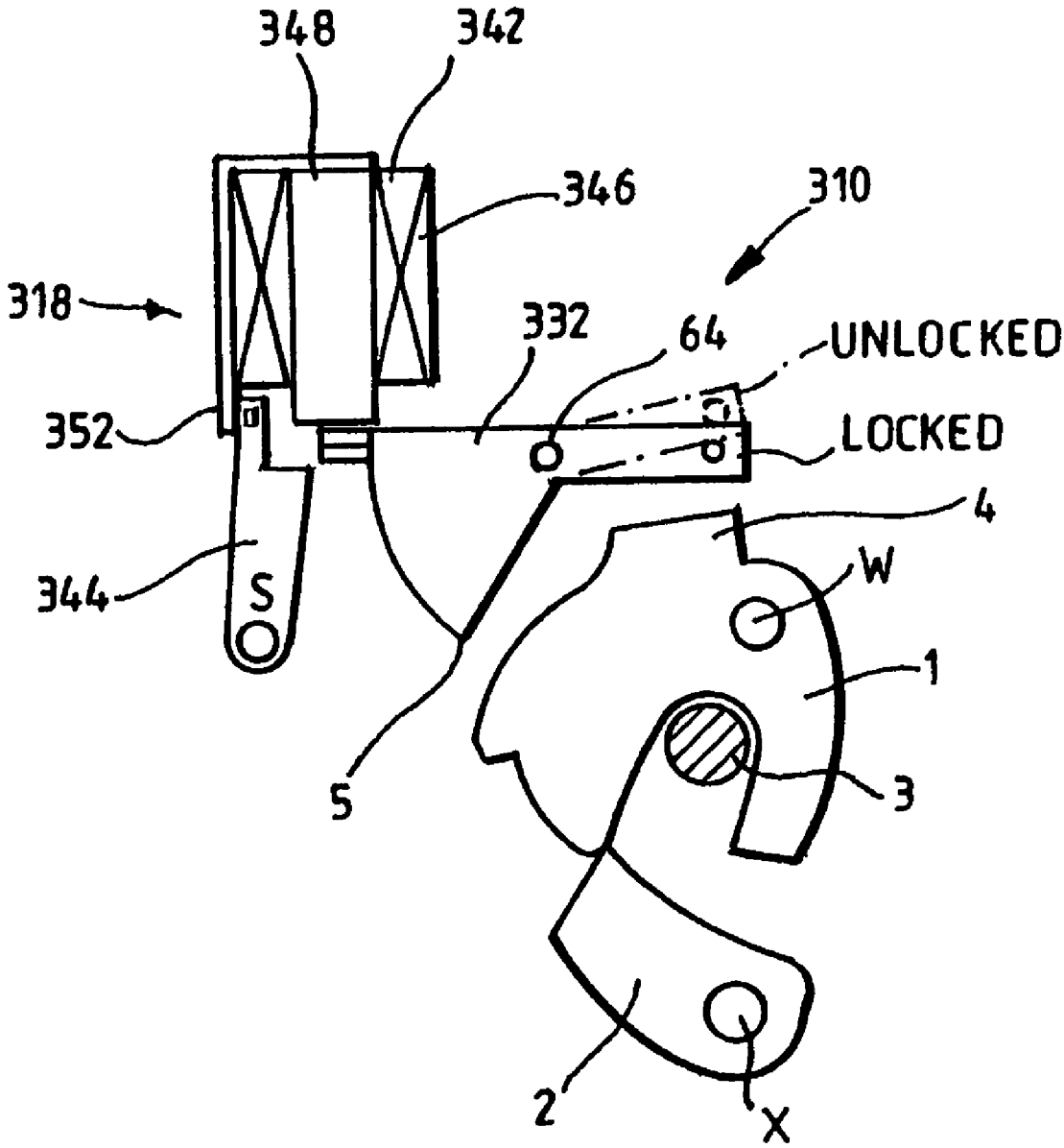
FIGS. 20, 20A, 20B, 20C and 20D show an embodiment of a latch arrangement according to another form of the present invention.

Further shown is a latch bolt in the form of a rotating claw 1 pivotably mounted about a pivot W, which is retained in the position shown in FIG. 20 by a pawl 2 that is pivotably mounted about a pivot X. A striker 3 can be retained in the position as shown in FIG. 20 to latch a door in a closed position. In this case, the claw 1 includes a cam lug 4 on the outer periphery thereof which engages a lug 5 of a lock/unlock lever 332, as will be further described below. In this case, there is further included an abutment 390 which limits counter-clockwise rotation of a release lever 326.

Figure 20A:
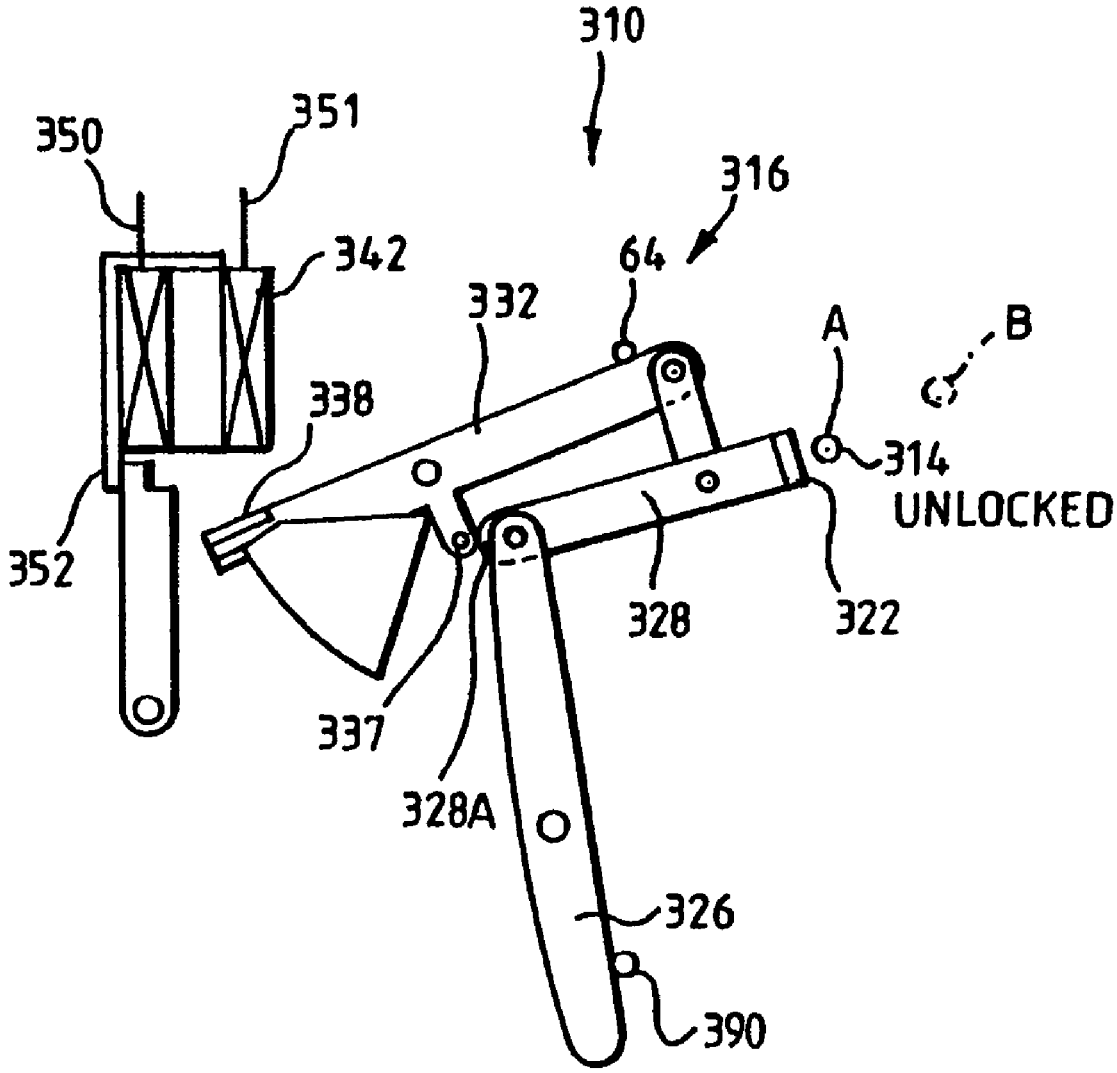

FIG. 20A shows the latch arrangement 310 in an unlocked condition wherein the release lever 326 abuts an abutment 390, a lock/unlock lever 332 abuts an abutment 364, and an end 328A of a release link 328 abuts a pin 337, with an abutment 338 being remote from the electromagnet 342. In this position, the abutment 338 aligns with a pawl pin 314. Note that the position of components shown in FIG. 20A is equivalent to the position of similar components as shown in FIG. 17.

Figure 20B:
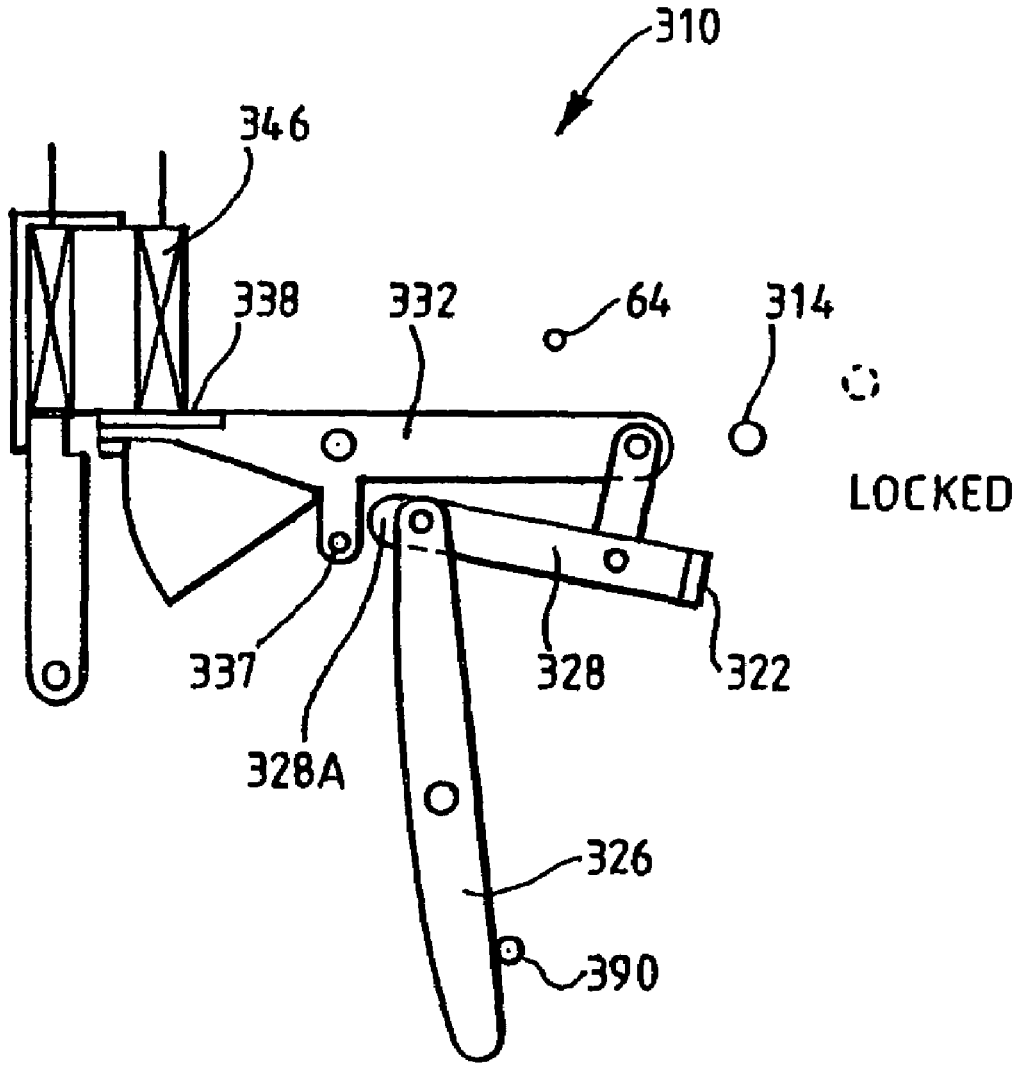

FIG. 20B shows the latch arrangement 310 in a locked condition where electrical power is fed to the windings 346 to maintain the abutment 338 in engagement with the electromagnet 342. The release lever 326 still engages the abutment 390, while the lock/unlock lever 332 no longer engages the abutment 364 and the end 328A of the release link 328 no longer engages the pin 337. The abutment 338 is now misaligned with the pawl pin 314. Thus, pivotal movement of the release lever 326 in a clockwise direction will cause the abutment 338 to bypass the pawl pin 314, and thus the door will remain closed.

Figure 20C:
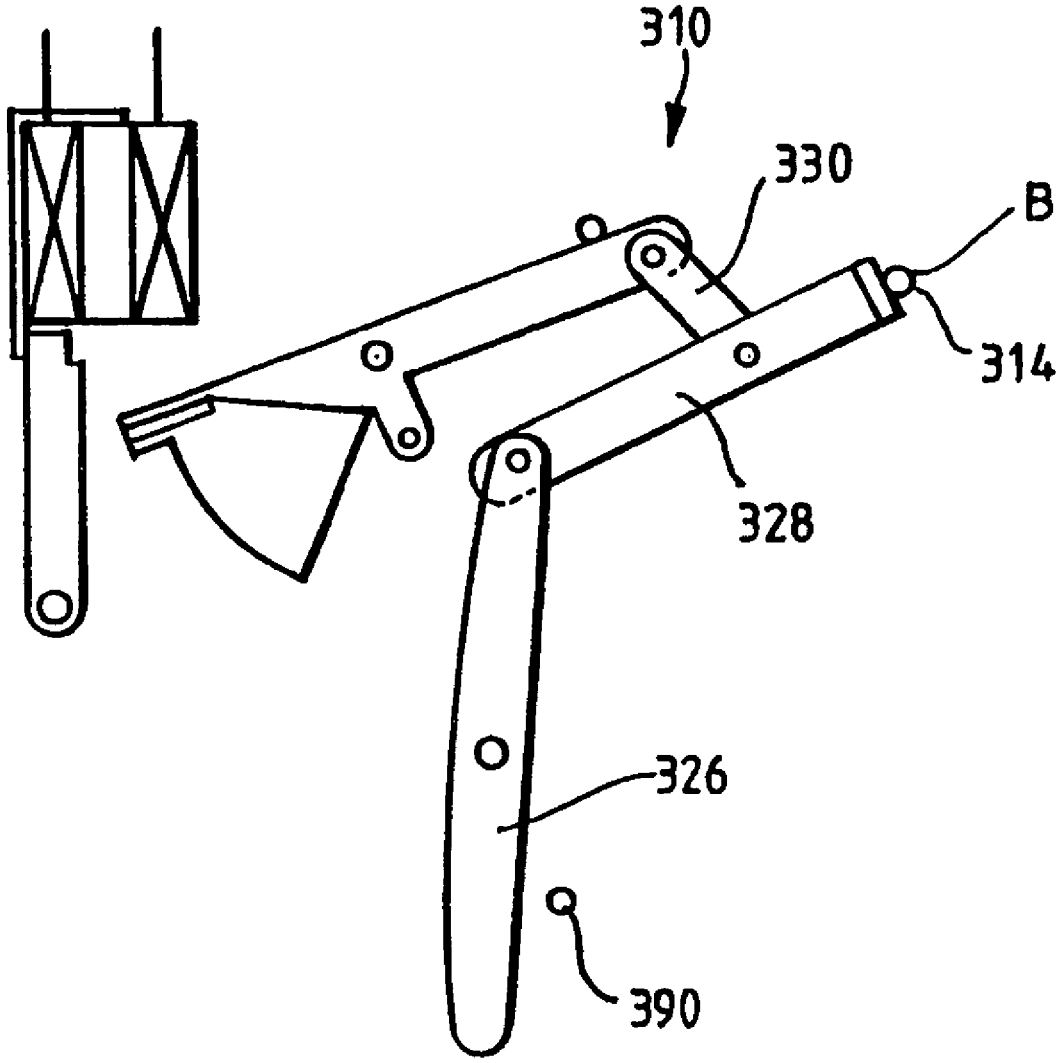

Consideration of FIG. 20A shows that in the event that the release lever 326 is pivoted in a clockwise direction to disengage with the abutment 390, the release lever 326, the release link 328, and the connector 330 will move to the position as shown in FIG. 20C, resulting in the abutment 322 engaging and moving the pawl pin 314 to position B, as shown in FIG. 20C, thus allowing the door the to open.

Figure 20D:
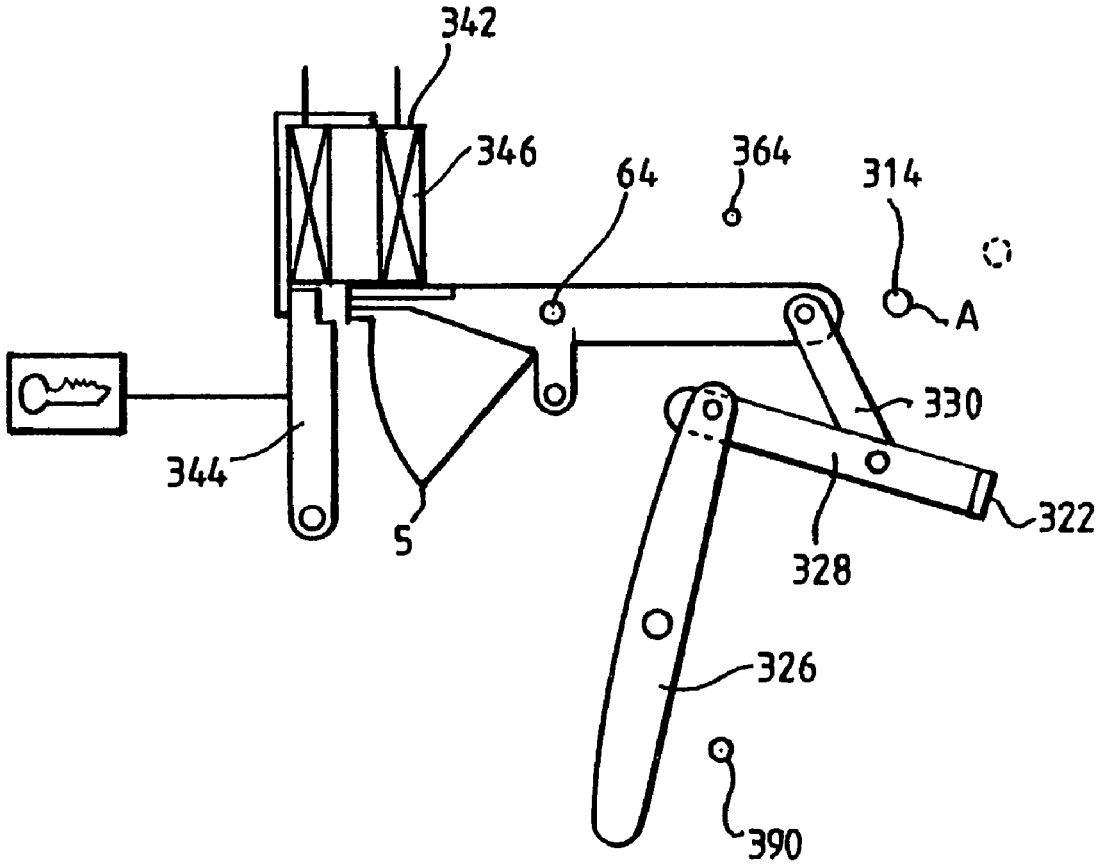

The latch arrangement 310 only momentarily achieves the position as shown in FIG. 20C because once in this position, the claw 1 rotates counter-clockwise about a pivot W. This simultaneously releases the striker 3 from the mouth of the claw 1 and also causes the cam lug 4 to contact the lug 5, thus driving the lock/unlock lever 332 to the position as shown in FIG. 20D. This in turn allows the pawl pin 314 to return to the position A and causes the connector 330 and the release link 328 to adopt the position as shown in FIG. 20D.

As shown in FIG. 20D, the release lever 326 is disengaged from the abutment 390 i.e., an inside door handle or an outside door handle is still in an actuated position. With the inside door handle or the outside door handle in the actuated position, the door latch can then be locked either by supplying and maintaining power to the windings 346, by pulsing the windings 346 such that the pawl 344 moves clockwise to a position equivalent to that shown in FIG. 16B, or by manual operation of the key again moving the pawl 344. Subsequent release of the inside door handle or the outside door handle will either return the latch arrangement 310 to the position as shown in FIG. 20B (when power is supplied and maintained to the windings 346) or to the position as shown in FIG. 20B, except with the pawl 2 moved across.

Alternatively, where no power is supplied to the windings 346, then neither the electromagnet 342 nor the pawl 344 will restrict rotational movement of the lock/unlock lever 332 which will return to the position as shown in FIG. 20C upon release of the inside door handle or the outside door handle.

The electromagnet 342 is therefore only required to hold the lock/unlocked lever 332 in the locked position, as shown in FIG. 20, and is not required to return it to the position from the unlocked position since this is carried out by cooperation between the cam lug 4 and the lug 5.

In an alternative embodiment, it is possible to provide an electromagnet 342 which is sufficiently powerful to move the lock/unlock lever 332 from the position as shown in FIG. 20A to the position as shown in FIG. 20B to be able to lock the door without having to open the door.

There now follows a description of another embodiment of an actuator according to the present invention used as part of a latch arrangement. The present invention can be used in the latch arrangement, and in particular a latch arrangement for land vehicles, such as cars.

Known door latches need to keep the associated vehicle door in a closed position in the event of a road accident. Under such circumstances, the closed vehicle door contributes significantly to the strength of the passenger safety cell. Conversely, in the event that the door is forced open during a road accident, the passenger safety cell strength is severely compromised, thus possibly endangering the passengers and driver of the vehicle.

An impact occurring during a crash can deform the vehicle door, and the normal release mechanism of the latch is inadvertently operated, thus releasing the door.

An object of the present invention is to provide a door latch which is less likely to unlatch during a crash.

Thus, in one form of the invention, a latch arrangement includes a latch and a release mechanism operable such that when the latch in an unlocked latched first condition, an initial operation of the release mechanism changes a state of the latch to a latched second condition that is different from the first condition. A subsequent operation of the release mechanism unlatches the latch. The actuator according to the present invention can be used to lock the latch.

It is also known to have latches which are power openable, that it the mechanism that opens the latch can be driven by an actuator, such as an electric motor.

The signal to operate the power actuator is generated by an initial movement of an outside door handle associated with the latch/power actuator. Since the initial movement of the outside door handle simply operates a signalling switch, the force required to lift the outside door handle during this initial movement is very low.

However, if the power actuator malfunctions, further movement of the outside door handle causes mechanical components of the door latch to move and release the latch. Thus, the force required to lift the door handle during this subsequent movement is considerably more than the force required to lift the door handle during the initial movement.

There is an ongoing requirement for vehicles to have reduced noise levels, and in particular reduce wind noise levels. Reduced wind noise levels can be achieved by increasing the seal load acting between the door and the adjacent door aperture of the vehicle. However, an increase in seal load also requires an increase in the force required to unlatch the latch.

It is difficult to control the tolerances on seal loads between various doors of a vehicle, and therefore the force required to unlatch the latch on different doors of the same vehicle varies significantly. As such, during power opening of a door latch, different doors of the same vehicle may take different times to open.

In particular, where a power actuator takes a significantly longer time than usual to open the associated door, the person lifting the door handle may well have moved the door handle from the initial position into the manually opening phase of the door handle.

As such, a person opening different doors of the same vehicle can be required to input significantly different forces into each door handle.

An object of a preferred embodiment of the present invention is to alleviate this problem. Thus, according to the present invention, the latch arrangement is preferably further operable by a power actuator.

When providing a power openable door latch which requires an initial and subsequent operation of a release mechanism, the initial operation can be chosen to move only a certain number of components of the latch. In particular, the tolerances on these particular components can be tightly controlled. Furthermore, the force required to move these components can be relatively low. Thus, the force required to fully actuate an outside door handle on the first occasion can remain low. Furthermore, this force is consistent when compared with other door handles of the same vehicle.

The time taken to manually fully lift an outside door handle is considerably longer than the time required for the power actuator to unlatch the latch. Thus, under normal circumstances when the latch is being power unlatched, the door will open sometime when the outside door handle is being lifted, even though the lifting the outside door handle is not acting to unlatch the latch. It is therefore easier to achieve a consistent "feel" to all latches on a particular vehicle.

Preferably, the latch has a locked condition such that any number of operations of the release mechanism does not unlatch the latch when in the locked condition. Preferably, the latch arrangement includes a latch bolt releasably retainable in a closed position by a first pawl.

Preferably, the first pawl is operable by a pawl lifter, and the pawl lifter is moveable relative to the pawl from a first relative position corresponding at least to the unlocked latched first condition to a second relative position corresponding at least to the latched second condition.

Preferably, the pawl lifter is moveable relative to the first pawl by virtue of a lost motion connection between the pawl lifter and the first pawl. Preferably, the lost motion connection is in the form of a projection on one of the pawl lifter and first pawl that engages a slot in the other of the pawl lifter and first pawl. Preferably, one of the pawl lifter and first pawl is pivotally mounted. Preferably, both are pivotally mounted, and more preferably, both are pivotally mounted about the same axis.

Preferably, the pawl lifter is biased to the first relative position. Preferably, the pawl lifter is retainable in the second relative position by a second pawl.

Preferably, with the first pawl in the released position, the second pawl is not capable of retaining the pawl lifter in the second relative position. Preferably, with the latch bolt in the open position, the latch bolt engages the first pawl to keep the first pawl substantially in the released position.

Preferably, the first pawl includes an abutment engageable with the second pawl such that the abutment engages the second pawl to move the second pawl to the released position with the first pawl in the released position.

Preferably, the release mechanism includes a ratchet mechanism having a first ratchet tooth and a second ratchet tooth to change a state of the latch between the unlocked latched first condition and the latched second condition and between the latched second condition and the unlatched condition upon respective engagement with a ratchet abutment.

Preferably, the ratchet teeth and the ratchet abutment are in substantially permanent operable engagement. Preferably, the ratchet teeth and the ratchet abutment are capable of being maintained in a disengaged position to lock the latch. Preferably, one of the first ratchet teeth and the second ratchet teeth and the ratchet abutment are mounted on a ratchet lever. Preferably, the ratchet abutment is mounted on the ratchet lever, and the ratchet teeth are mounted on the pawl lifter. Preferably, the ratchet lever is pivotally mounted on a release lever. Preferably, the release lever is pivotally mounted on a chassis of the latch. Preferably, the ratchet lever is pivotally connected at a first link pivot to a link, and the link constrains the first link pivot to move about an arc when the latch is locked.

Preferably, the link is pivotally mounted on a lock link at a second link pivot. Preferably, the lock link can be retained in a lockable position to lock the latch. Preferably, with the latch in an unlocked condition, the lock link can be moved to the lockable position by return movement of the release mechanism. Preferably, the lock link is moved to the lockable position by return movement of the release lever.

Preferably, the latch arrangement is further operable by a power actuator. Preferably, the power actuator is connected on a first pawl transmission path side of the ratchet mechanism. Preferably, the power actuator is connected on a first pawl transmission path side of a connection between the pawl lifter and the first pawl. Preferably, the release mechanism is connected to an outside door handle.

Figure 21:
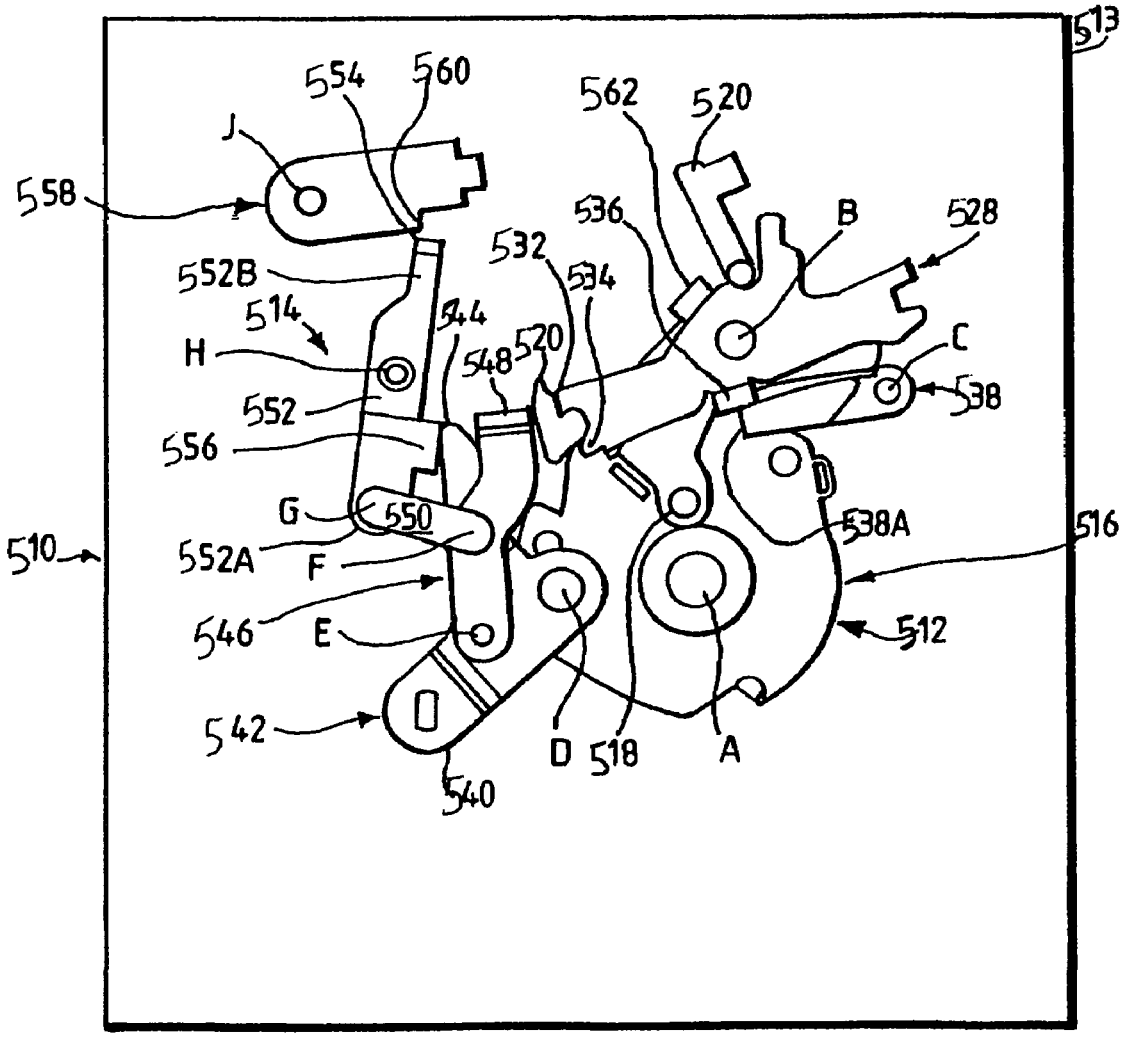
FIG. 21 is a view of a latch arrangement according to another form of the present invention in an unlocked latched first condition.
Figure 23:
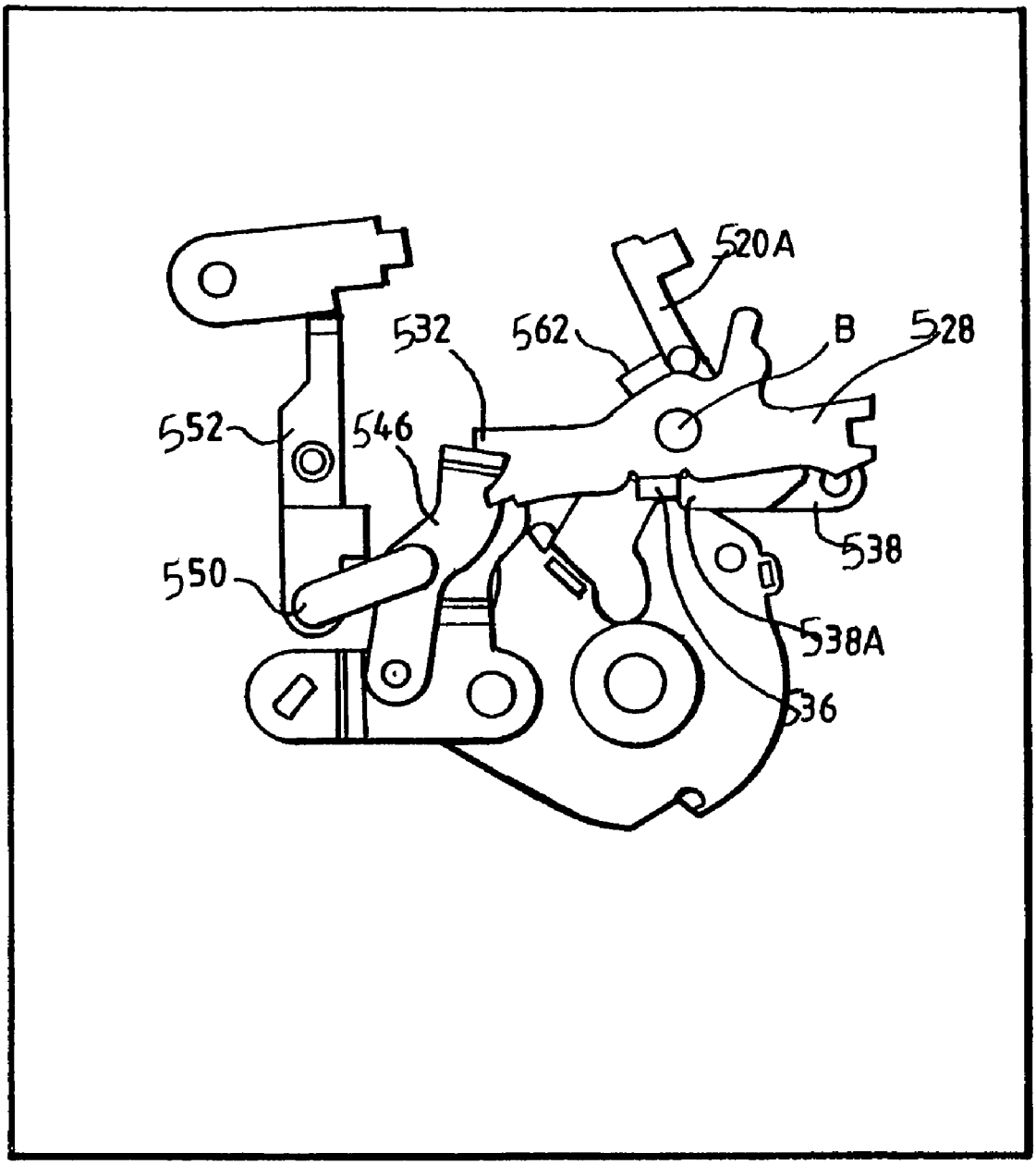
FIG. 23 is a view of the latch arrangement of FIG. 21 having completed the first actuation.
Figure 24:
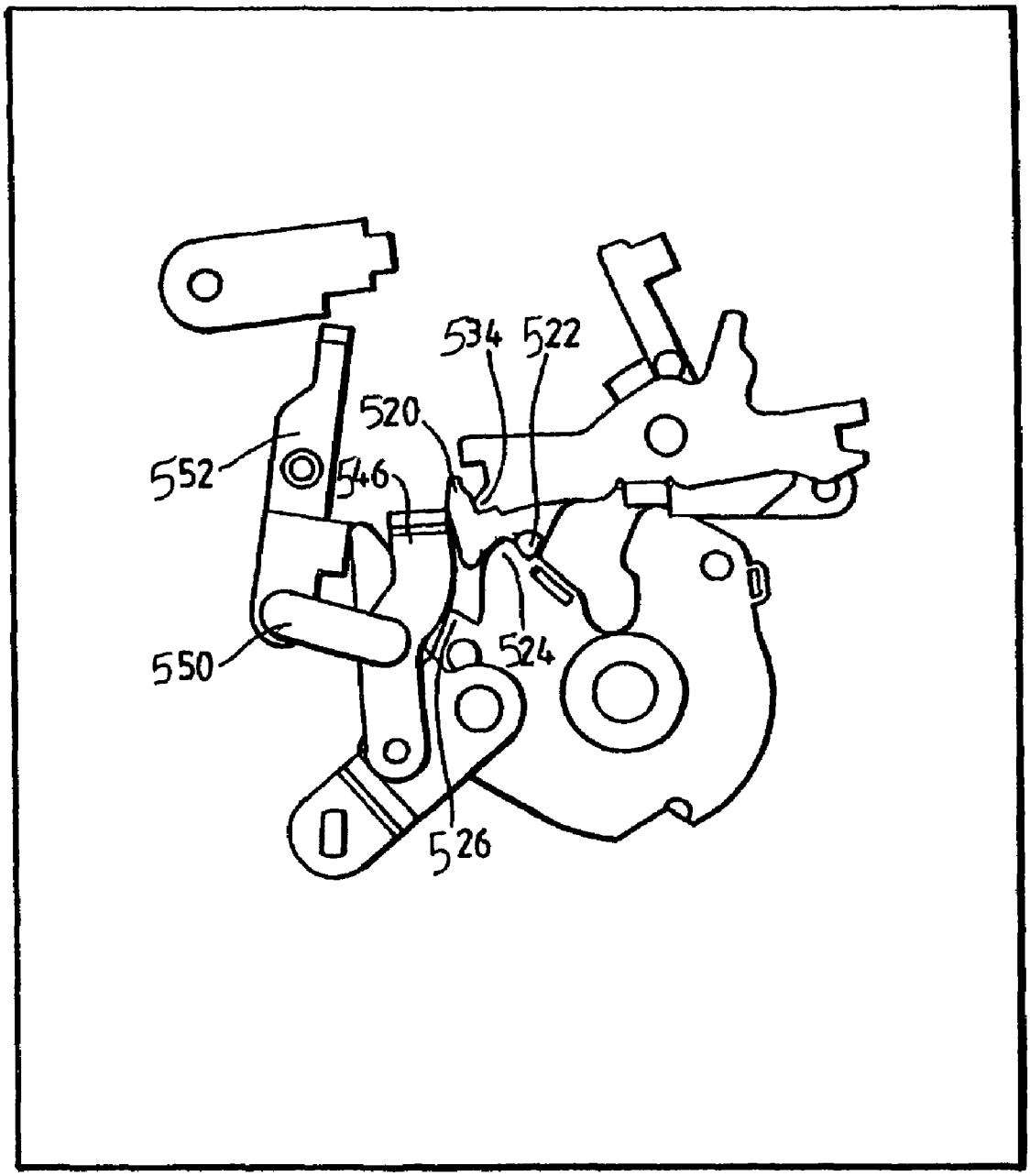
FIG. 24 is a view of the latch arrangement of FIG. 21 with the release mechanism having been released and with the latch in a latched second condition.
Figure 25:
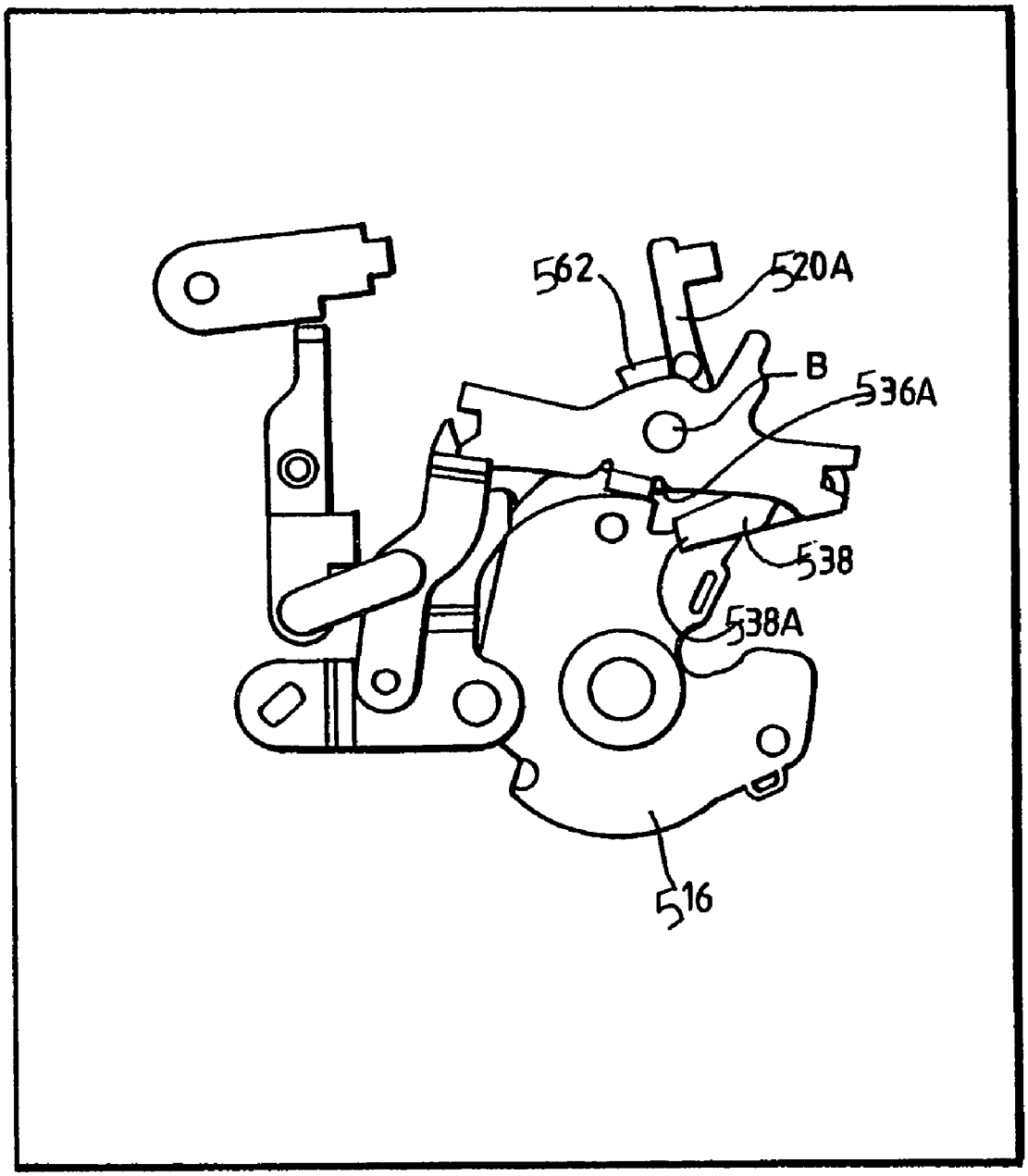
FIG. 25 is a view of the latch arrangement of FIG. 21 shown in a released position, having been mechanically released.
Figure 26:
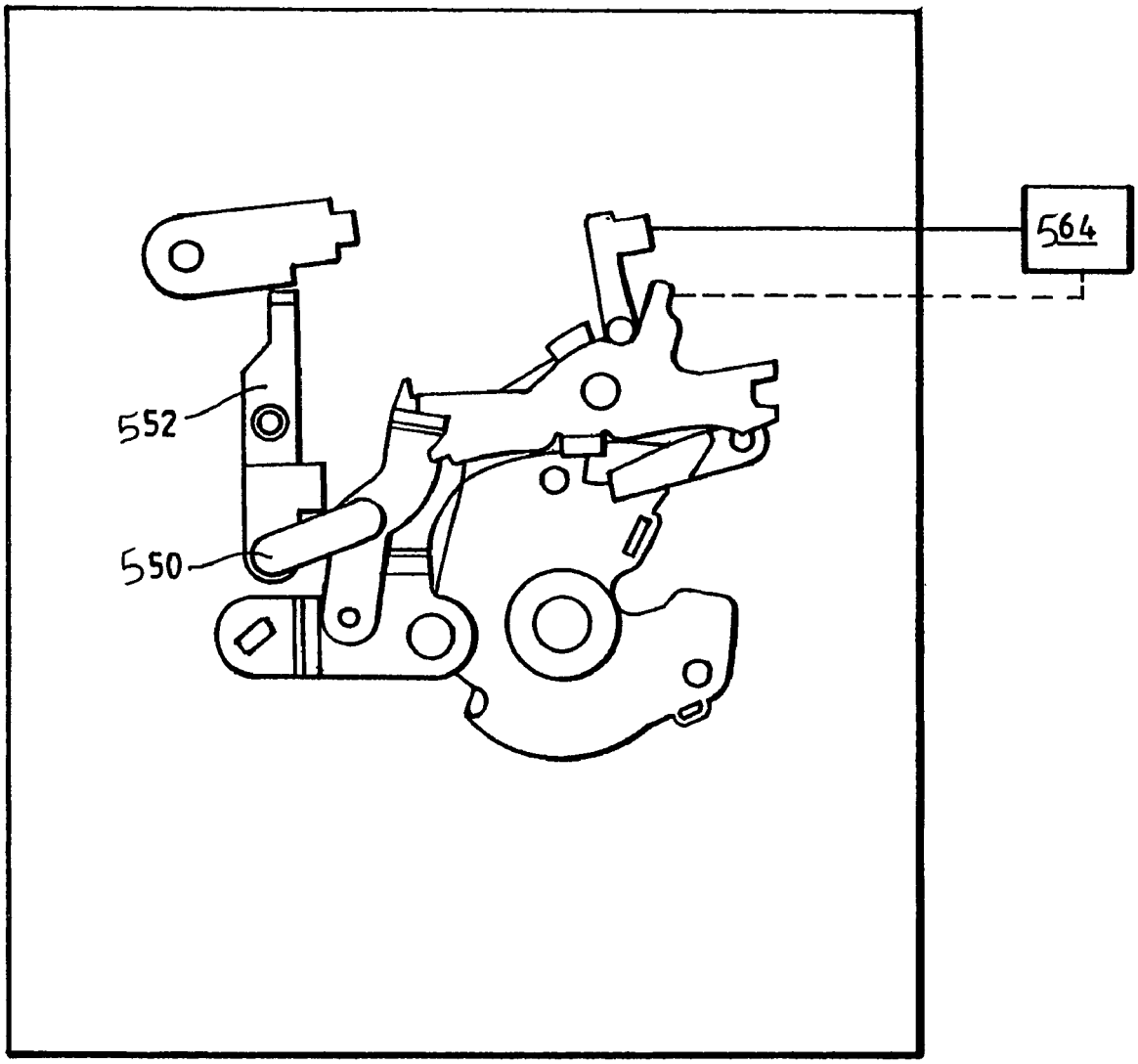
FIG. 26 is a view of the latch arrangement of FIG. 21 shown in a released position having been released by a power actuator.
Figure 28:
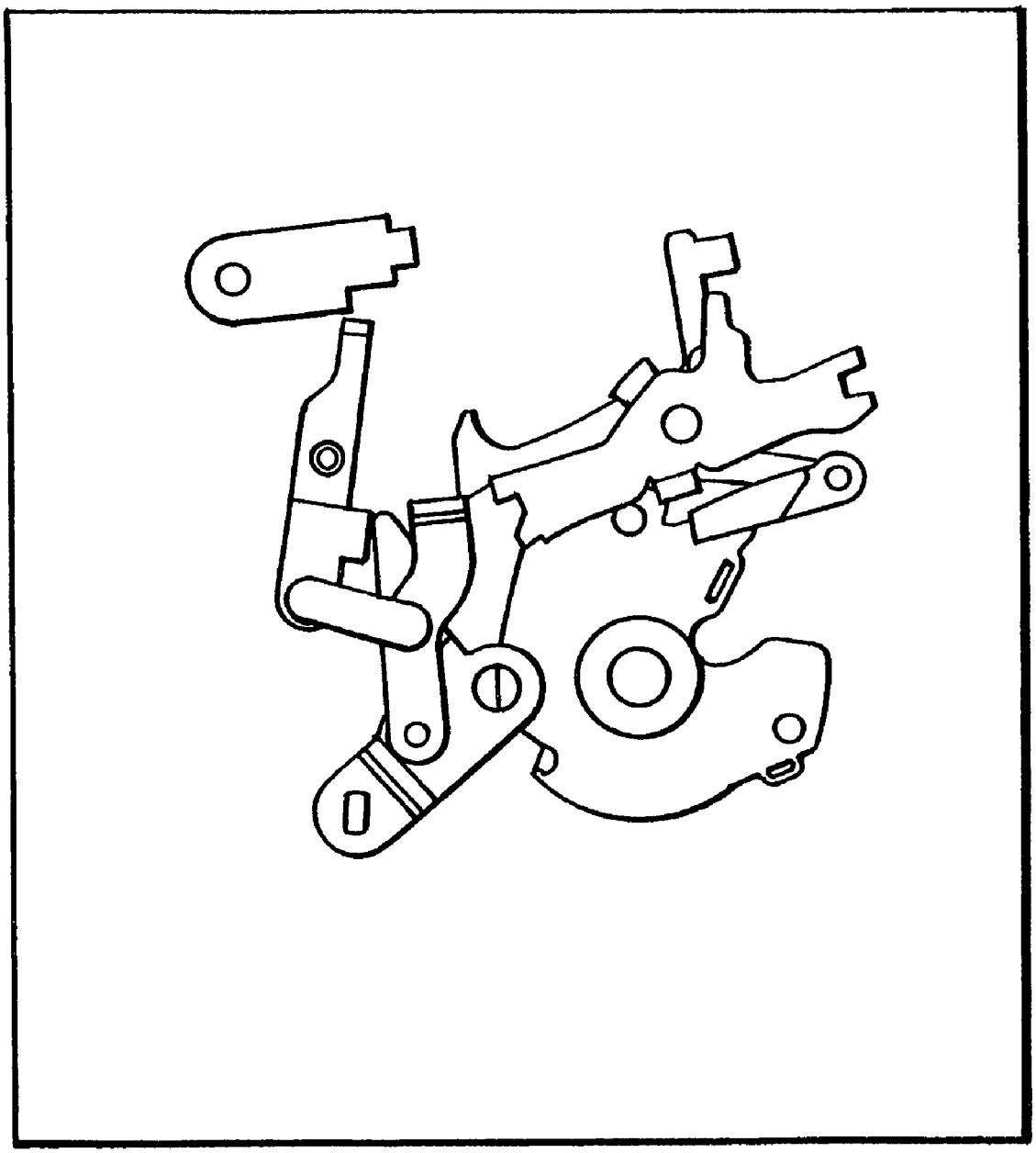
FIG. 28 is a view of the latch arrangement of FIG. 21 shown in an unlatched condition with the release handle in a rest position.
Figure 29:
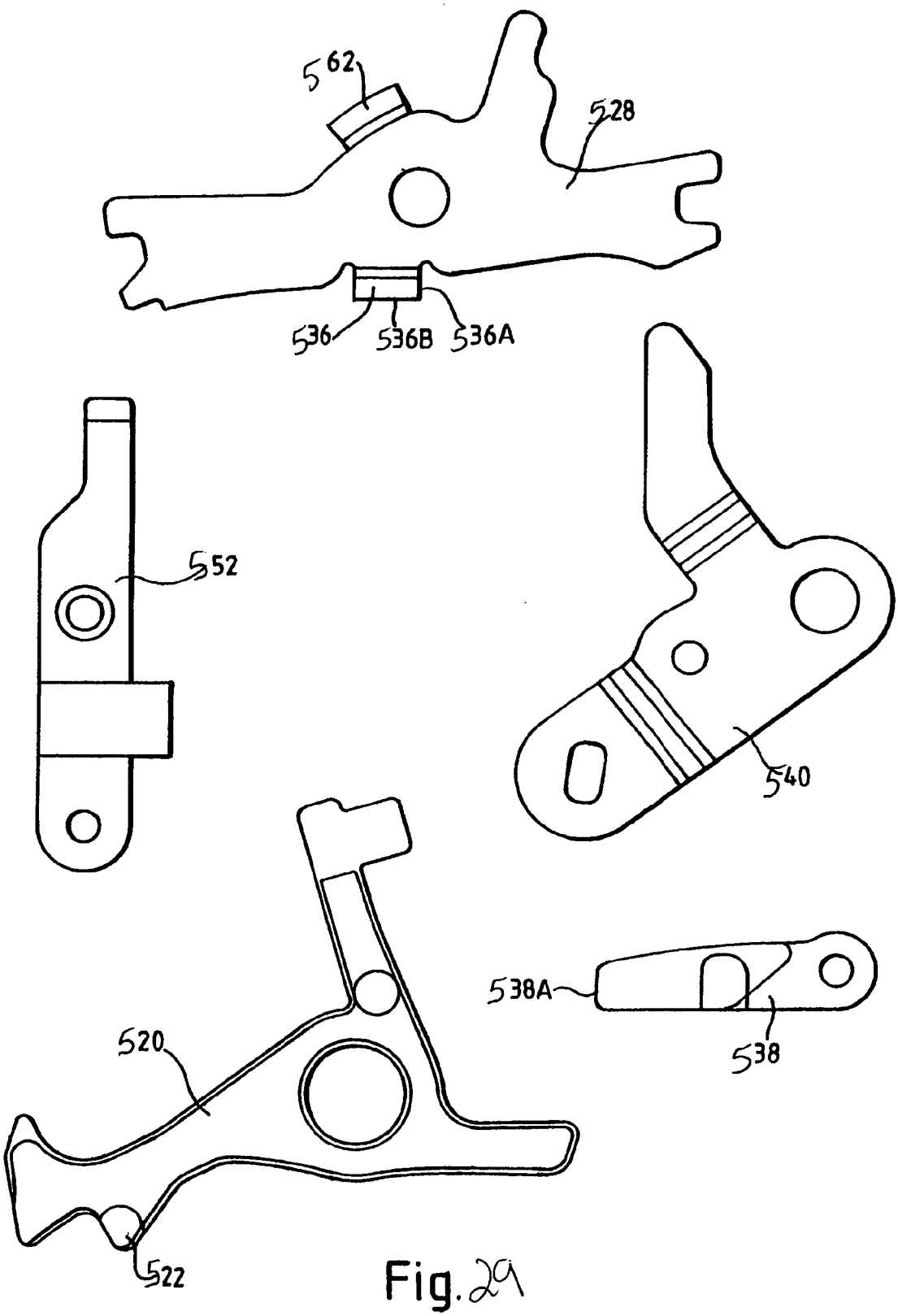
FIG. 29 is a view of various components of the latch arrangement of FIG. 21 shown in isolation for clarity.
Figure 30:
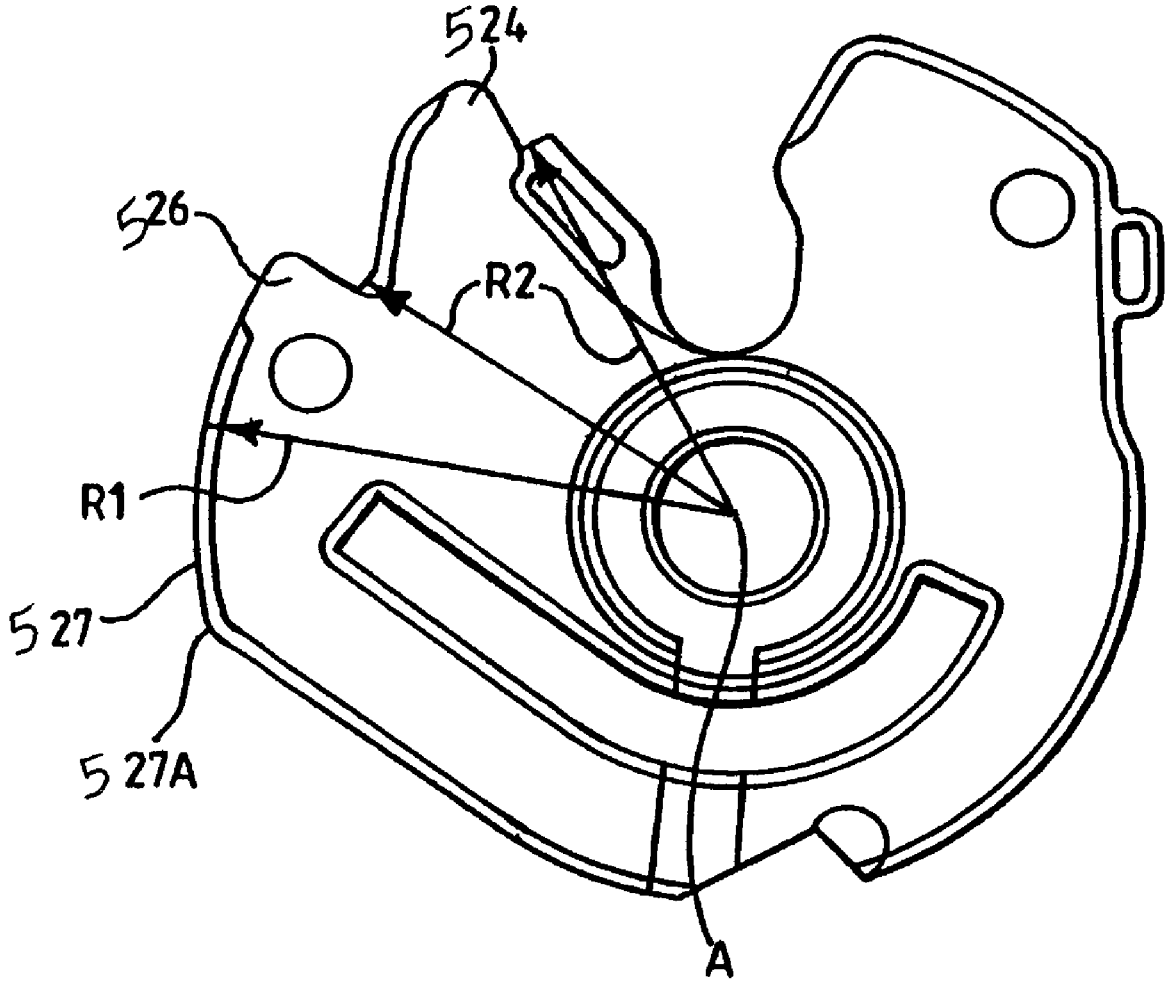
FIG. 30 is a view of the claw of the latch arrangement of FIG. 21 shown in isolation.

FIGS. 21 to 25 sequentially show the sequence of events required to manually release the latch in the event of failure of the power unlatching actuator. FIGS. 21 to 25 show a latch arrangement 510 including a latch 512 and a release mechanism 514. The latch 512 includes a pivotally mounted latch bolt in the form of claw 516. The claw 516 can move between a closed position (as shown in FIG. 21) whereupon the claw 516 retains a striker 518 and an open position (as shown in FIGS. 25, 26 and 28) wherein the striker 518 is released, thus allowing the door to open. The claw 516 can also be retained in a "first safety" position (not shown), whereupon the associated door cannot be opened, but nevertheless is not fully shut.

The latch 512 further includes a first pawl 520 pivotally mounted to a chassis 513 (shown schematically) of the latch 512 at a pivot B. The first pawl 520 includes a pawl abutment 522 for engagement with a claw abutment 524 or a claw first safety abutment 526. The claw 516 includes a claw release abutment 527, and the pawl abutment 524 rests on an end 527A of the claw release abutment 527 when the claw 516 is in the open position (FIGS. 25, 26 and 28). The claw release abutment 527 is positioned at a radius R1 which is greater than a radius R2 of the claw abutment 524 and the first safety abutment 526. Thus, with the latch 512 in a closed position or a first safety position, the claw abutment 524 sits at radius R2 relative to an axis A, which is closer to the axis A than when the pawl abutment rests on the claw release abutment 527 when the latch 512 is in the open position. The pawl 520 is generally planar and sits below the pawl lifter 528 when viewing FIG. 21. The pawl lifter 528 is also generally planarand pivotally mounted at a pivot B. The pawl lifter 528 includes a first ratchet tooth 532, a second ratchet tooth 534, and an abutment 536.

Figure 22:
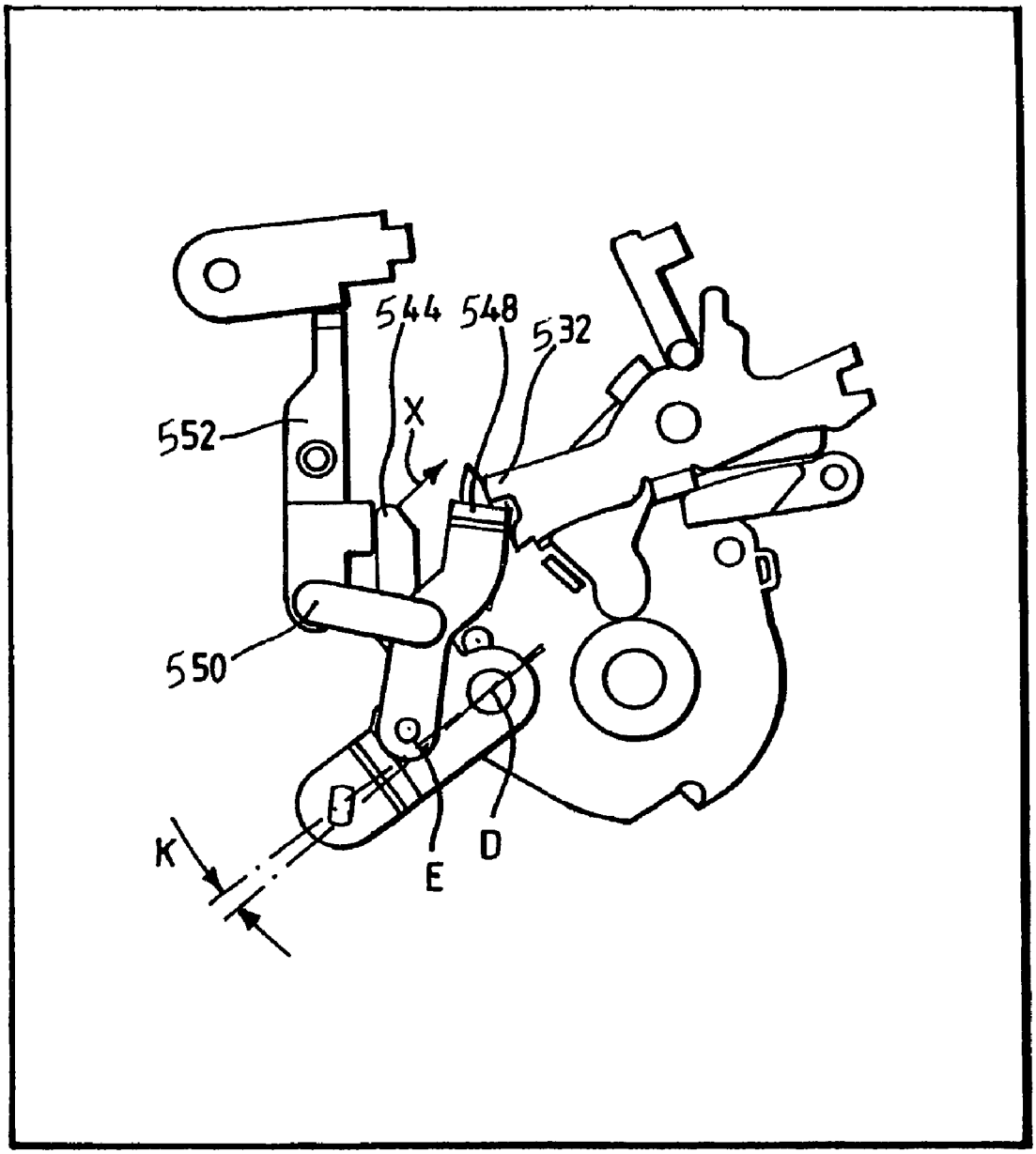
FIG. 22 is a view of the latch arrangement of FIG. 21 partially through a first actuation of the release mechanism.

A second pawl 538 is pivotally mounted at a pivot C to the chassis 513 of the latch 512. The second pawl 538 can be engaged with an end 536A of the abutment 536, as shown in FIGS. 23 and 24, and can be disengaged from the end 536A, as shown in FIGS. 21, 22 and 25, as will be further described below. An outside release lever 540 is connected to an outside release handle (not shown) at an end 542. The outside release lever 540 is pivotally attached to the chassis 513 of the latch 512 at a pivot D. The outside release lever 540 includes a projection 544.

A ratchet lever 546 is pivotally mounted at a pivot E (situated between the pivot D and the end 542). The ratchet lever 546 includes a ratchet abutment 548 that is remote from the pivot E.

A first link pivot F is situated between the ratchet abutment 548 and the pivot E, which pivotally connects the link 550 with the ratchet lever 546. The end of the link 550 remote from the first link pivot F is pivotally mounted at second link pivot G to end 552A of the lock link 552. The lock link 552 is pivotally mounted at a pivot H to the chassis 513 of the latch 512. The end 552B of the lock link 552 includes a lock abutment 554. The lock link 552 further includes a return abutment 556 between the pivot H and the end 552A.

The lock toggle 58 is pivotally mounted at a pivot J to the chassis 513 of the latch 512 and includes a toggle abutment 560. The lock toggle 558 forms the toggle part of an actuator 558A according to the present invention, only shown in FIG. 27 for clarity. The actuator 558A further includes an electromagnetic coil assembly 558B, a core 558C and a frame 558D. One end of the frame 558D is connected to the core 558C. Operation of the actuator 558A to move the lock toggle 558 between the position shown in FIG. 27 and the position shown in, for example, FIG. 2, is substantially as hereinbefore described with reference to the previously mentioned actuators.

The lock link 552, the outside release lever 540, the pawl lifter 528 and the first pawl 520 are all biased in a counter-clockwise direction by an appropriate bias mechanism, such as springs (not shown). The claw 516 and the second pawl 538 are both biased in a clockwise direction by an appropriate bias mechanism, such as springs (not shown). The movement of the link 550 and the ratchet lever 546 is controlled by the combination of the lock link 552, the outside release lever 540 and the pawl lifter 528. Hence, the link 550 and the ratchet lever 546 are not required to be biased either clockwise or counter-clockwise. The lock toggle 558 can be moved between positions shown in FIGS. 21 and 27 by an actuator (not shown).

An actuator 564 (shown schematically on FIG. 26 only) is connected to the first pawl 520 and can be actuated to rotate the first pawl 520 in a clockwise direction to release the latch 512.

Note that in further embodiments, the actuator 564 could be connected to the pawl lifter 528 (as shown in dashed line in FIG. 26) to rotate the pawl lifter 528, and hence the first pawl 520, in a clockwise direction to release the latch 572.

In the event of failure of the actuator 564, operation of the latch arrangement is as follows. Consideration of FIG. 21 shows the latch 512 in a latched condition where the pawl abutment 522 engages the claw abutment 524 to retain the claw 516 in the closed position.

Figure 27:
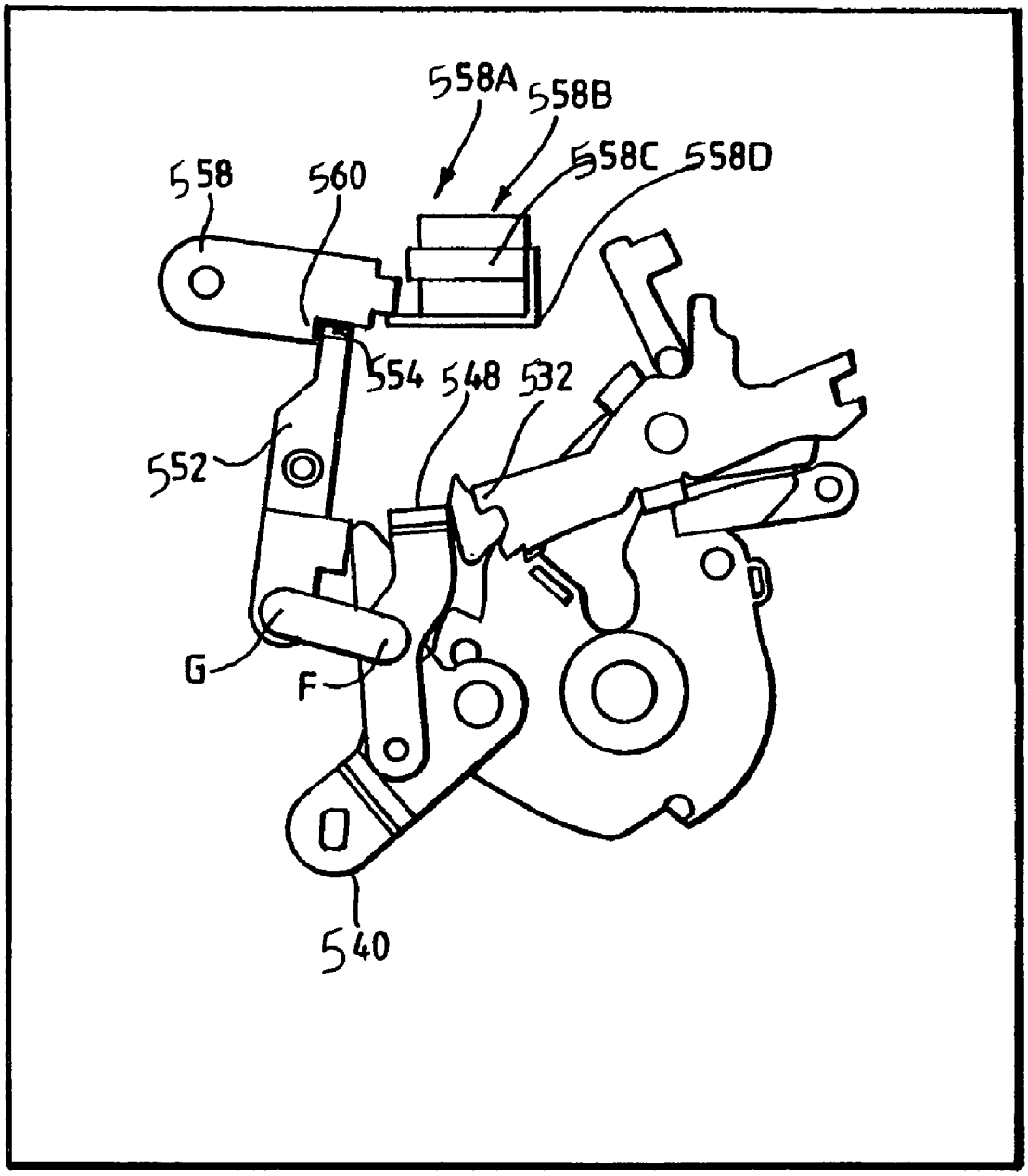
FIG. 27 is a view of the latch arrangement of FIG. 21 shown in a locked condition.

A comparison of FIGS. 21 and 27 shows that all components are in an identical position, except for the toggle lock 558. As shown in FIG. 21, the toggle lock 558 has been pivoted counter-clockwise such that the lock abutment 554 does not align with the toggle abutment 560. As shown in FIG. 27, the lock toggle 558 has been pivoted clockwise such that the lock abutment 554 is aligned with the toggle abutment 560. FIG. 27 shows the latch arrangement in a locked condition, and FIG. 21 shows the latch arrangement in an unlocked condition. However, it should be noted that, as shown in FIG. 21, the lock link 552 is nevertheless in a lockable position since the toggle lock 558 can be pivoted clockwise. This can be contrasted with the position of the lock link 552, as shown in FIGS. 22 and 23, where it is not in a lockable position since the lock toggle 558 cannot be pivoted clockwise.

The projection 544 of the outside release lever 540 engages the return abutment 556 of lock link 552. This engagement causes the lock link 552 to be positioned as shown in FIG. 21, i.e., clockwise when compared with the position of the lock link 552, as shown in FIG. 22.

In FIG. 22, the outside release lever 540 has been pivoted clockwise about the pivot D through an angle K and moves the projection 544 clockwise about the pivot D in the general direction of an arrow X. This in turn has allowed the lock link 552 to pivot counter-clockwise, moving the link 550 generally to the right when viewing FIG. 22.

This in turn has caused the ratchet lever 546 to pivot clockwise about the pivot E, such that the ratchet abutment 548 is substantially engaged behind the first ratchet tooth 532. At this stage, the pawl lifter 528 and the first pawl 520 remain in the same position in FIG. 22 when compared with FIG. 21.

FIG. 23 shows the outside release lever 540 having been moved to the fully actuated position. The lock link 552 remains in the same position when comparing FIGS. 22 and 23. However, the ratchet lever 546 has been moved generally upwards, and the engagement between the ratchet abutment 548 and the first ratchet tooth 532 has caused the pawl lifter 528 to pivot clockwise when compared with FIG. 22. This clockwise rotation of the pawl lifter 528 allows the abutment 538A of the second pawl 538 to slide past the edge 536B of the abutment 536 and engage the end 536A of abutment 536, thus preventing the pawl lifter 528 from rotating counter-clockwise about the pivot B.

Furthermore, the pawl lifter abutment 562 has approached the arm 520A of the first pawl 520, but as shown in FIG. 23, has not yet moved the arm 520A. The pawl lifter 528 is moveable relative to the first pawl 520 by virtue of a lost motion connection between the pawl lifter 528 and the first pawl 520. In a further embodiment, the lost motion connection can be in the form of a projection on one of the pawl lifter 528 and the first pawl 520 engaging in a slot in the other of the pawl lifter 528 and the first pawl 520.

The first actuation of the outside release lever 540 has moved the components 540, 552, 550, 546, 528 and 538. However, as shown in FIG. 23, the latch, i.e., the claw 516 and the first pawl 520, remain unmoved and in the same position as shown in FIGS. 1 and 2.

FIG. 24 shows the outside release lever 540 having been released and returned to the position as shown in FIG. 21. This in turn has also moved the components 552, 550 and 546 to the position shown in FIG. 21. However, the pawl lifter 528 remains in the position as shown in FIG. 23 by virtue of the second pawl 538. In particular, as shown in FIG. 24, the second ratchet tooth 534 is now presented in substantially the same position as the first ratchet tooth 532, as shown in FIG. 21.

Thus, a subsequent actuation of the outside release lever 540 causes the ratchet abutment 548 to engage behind the second ratchet tooth 534 and further rotate the pawl lifter 528 to the position as shown in FIG. 25. However, in this case the pawl lifter abutment 562 causes the arm 520A to rotate clockwise about the pivot B, thus releasing the pawl abutment 522 from the claw abutment 524 and allowing the claw 516 to rotate clockwise to the open position.

FIG. 25 shows that the second pawl 538 has been disengaged from the pawl lifter abutment 536 of the pawl lifter 528. This is due to an abutment (not shown) on the first pawl 520 being moved (as the first pawl 520 rotates) to engage with the second pawl 538 and hence rotating the second pawl 538 counter-clockwise against the second pawl bias spring.

Thus, upon release of the outside release lever 540, the pawl lifter abutment 536 can bypass the abutment 538A of the second pawl 538 to achieve the position shown in FIG. 28.

With the actuator 564 operating correctly, operation of the latch arrangement is as follows. The latch 512 starts from the position as shown in FIG. 21. An initial operation of the outside door handle manually moves the latch components to the position as shown in FIG. 22. At this stage, a sensing device, such as a switch, is triggered which instructs the actuator to rotate the first pawl 520 in a clockwise direction. However, the power actuator does not act instantaneously and takes a finite amount of time to rotate the first pawl 520. Thus, the continued lifting of the outside door handle might typically position the latch components somewhere between the position as shown in FIG. 22 and FIG. 23 prior to the latch being power unlatched. Under these circumstances, clearly no subsequent manual operation of the outside door handle is required, and the latch might typically move from the position shown in FIG. 23 to the position shown in FIG. 26. Release of the outside door handle will then move the latch components to the position shown in FIG. 28.

Operation of the latch arrangement when in the locked position shown in FIG. 27 is as follows. As mentioned above, the toggle lock 558 has been rotated clockwise such that lock abutment 554 engages the toggle abutment 560. This prevents the lock link 552 from rotating counter-clockwise, and hence the second link pivot G remains fixed relative to the chassis 513. Thus, the first link pivot F is constrained to move about an arc centered at the second link pivot G. Thus, when the outside release lever 540 is actuated, the ratchet abutment 548 moves substantially upwardly when viewing FIG. 27 and bypasses the first ratchet tooth 532 without engaging it. Hence, the actuation of the outside release lever does not move the pawl lifter 528, and the latch 512 remains latched.

In a further embodiment, the actuator 564 does not need to be present. Thus, the latch 512 can only be opened manually and two actuations of the outside door handle will be required to open the latch.

Preferably, this arrangement has safety benefits in the event of a side impact on the vehicle. Thus, while a side impact on the vehicle door may deform the door such that the latch components move from the position shown in FIG. 21 through the position shown in FIG. 22 to the position shown in FIG. 23, under such circumstances the door does not open. This can be contrasted with known door latches wherein a single pull of the outside door handle opens the door. Such knows latches therefore run the risk that a single side impact to the door will also move the latch components to their unlatched position and hence allow the door to open.

Figure 31:
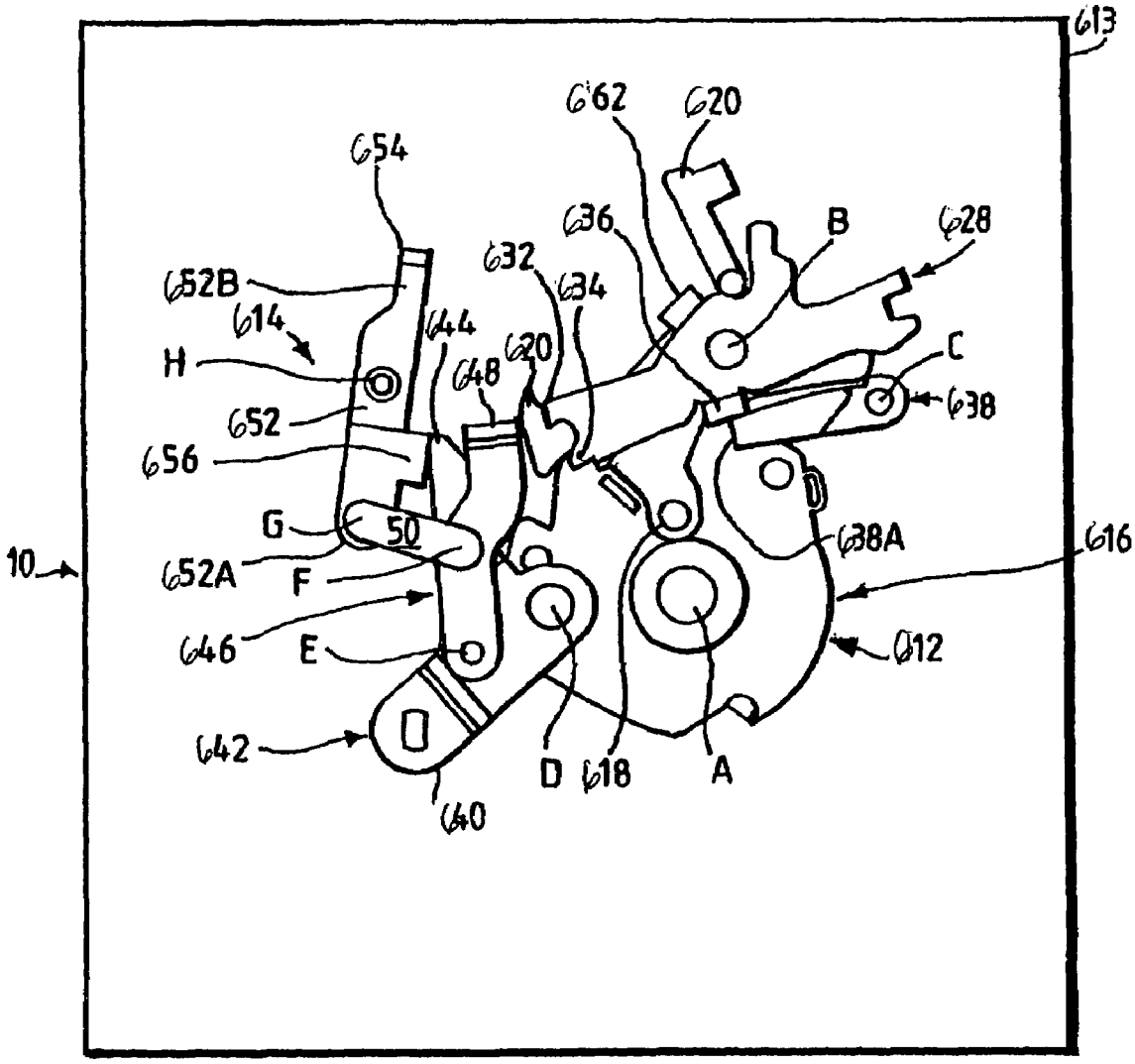
FIG. 31 is a view of a further embodiment of the present invention.
Figure 32:
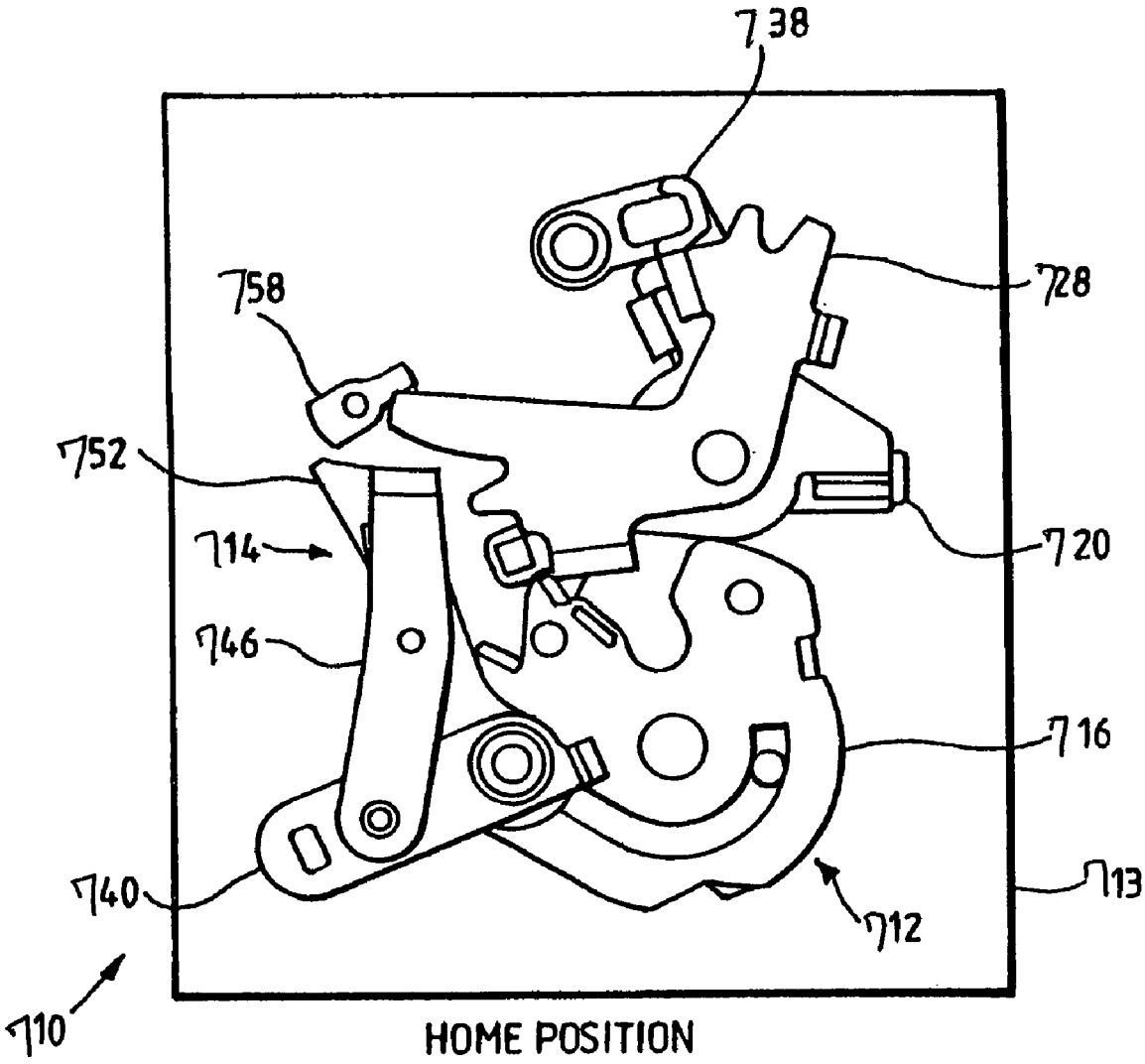
FIGS. 32 to 38 are views corresponding to FIG. 21 to 27, respectively, of a further embodiment of a latch arrangement according to the present invention.
Figure 33:
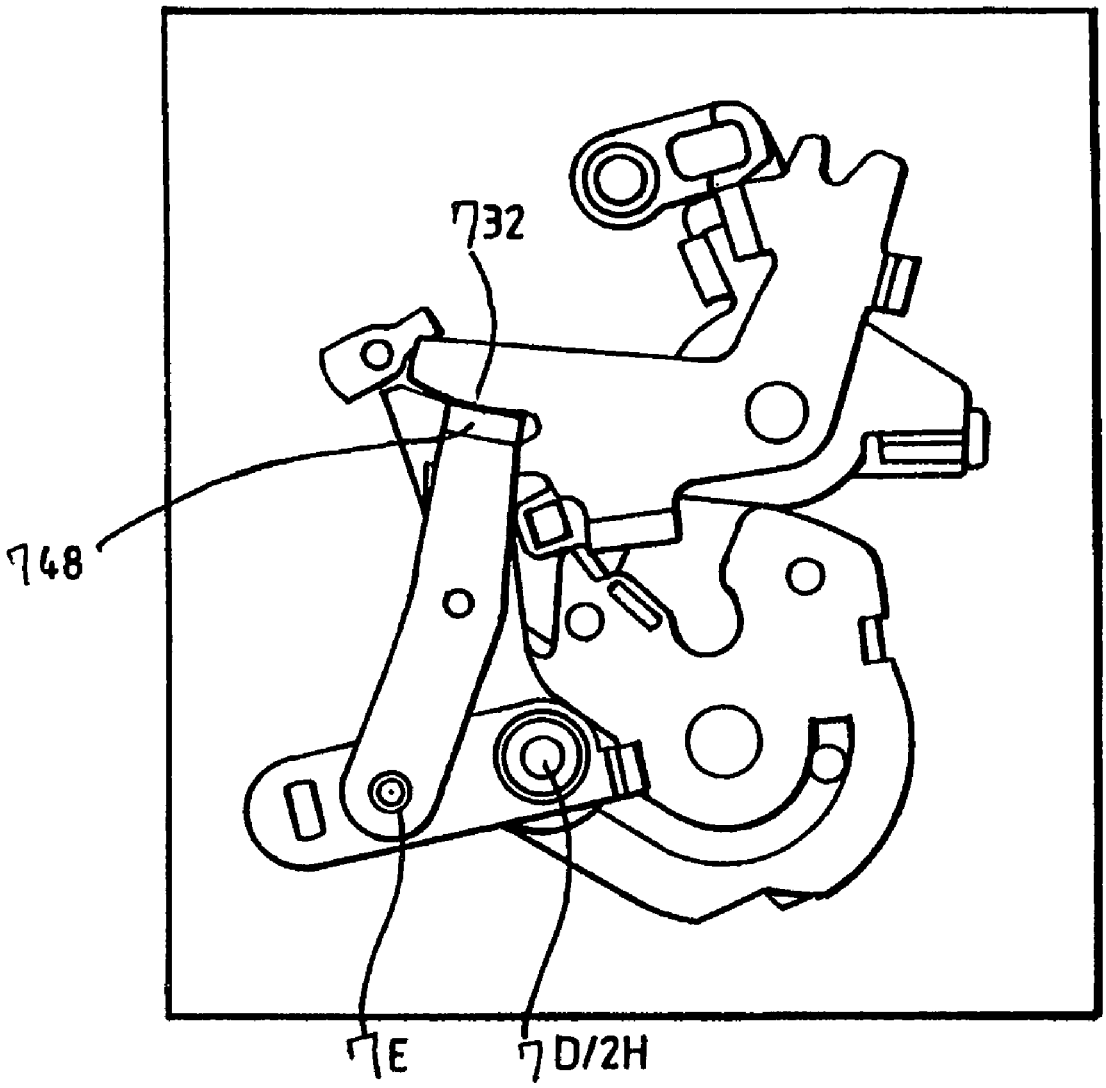
Figure 34:
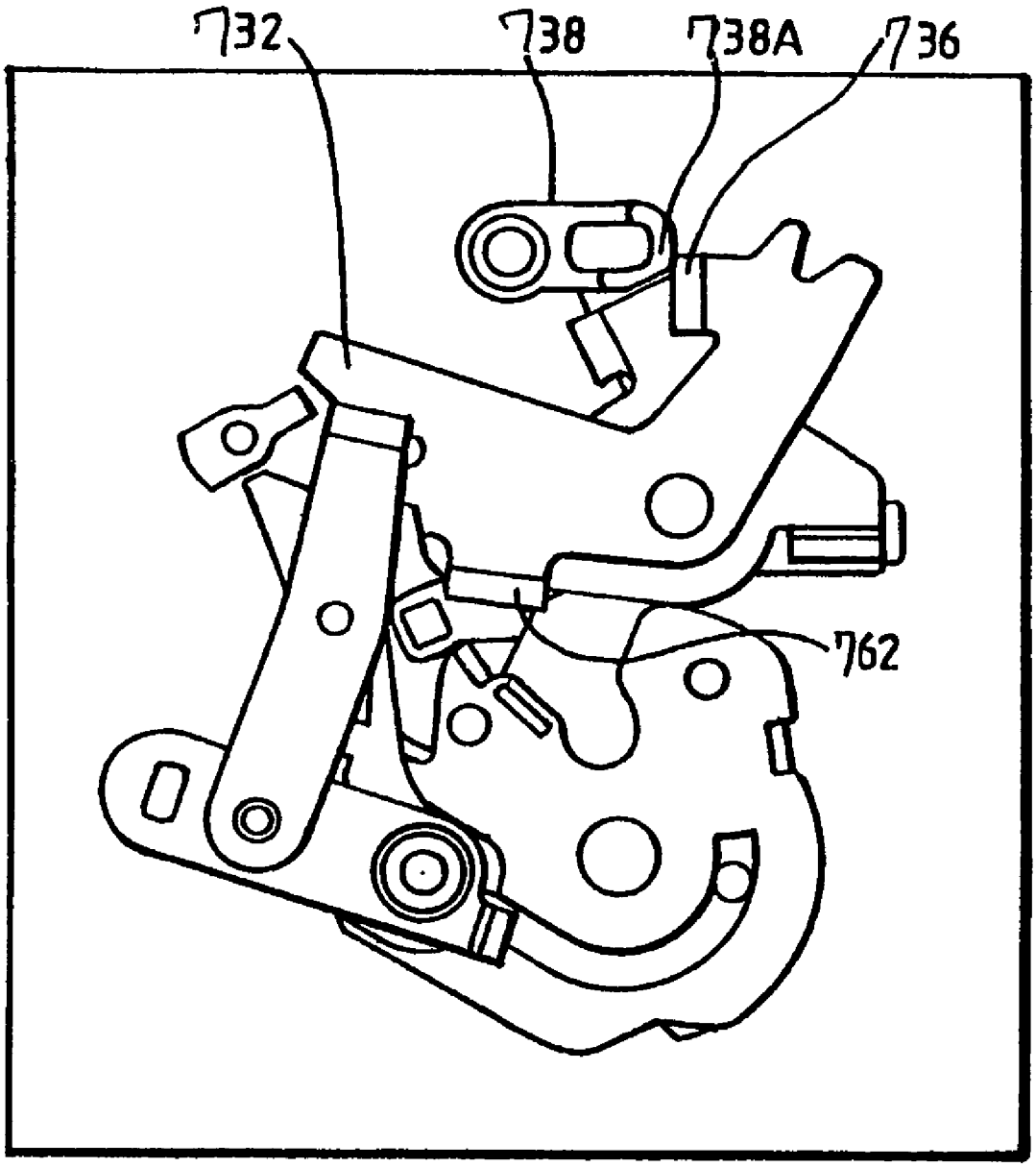
Figure 35:
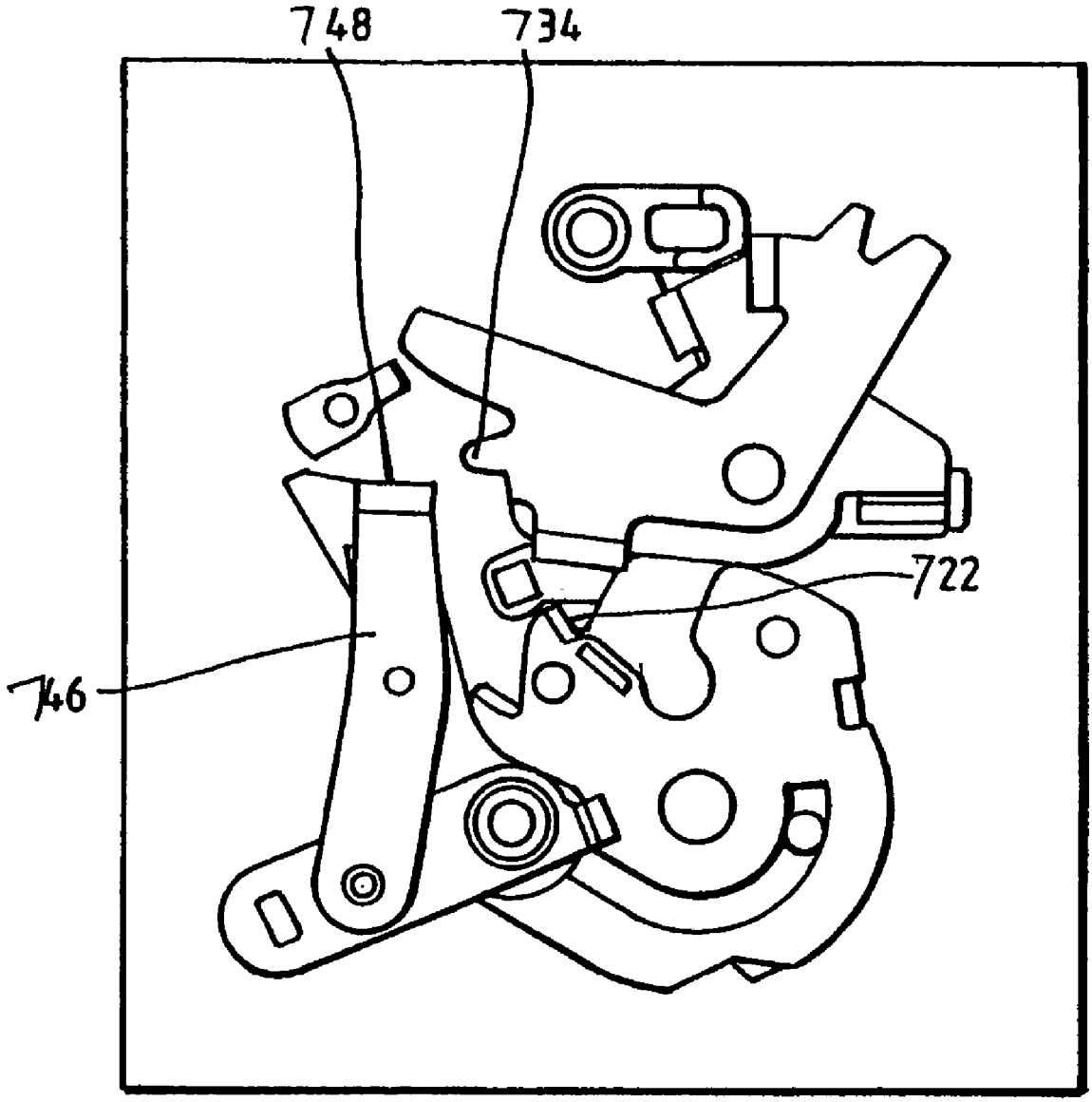
Figure 36:
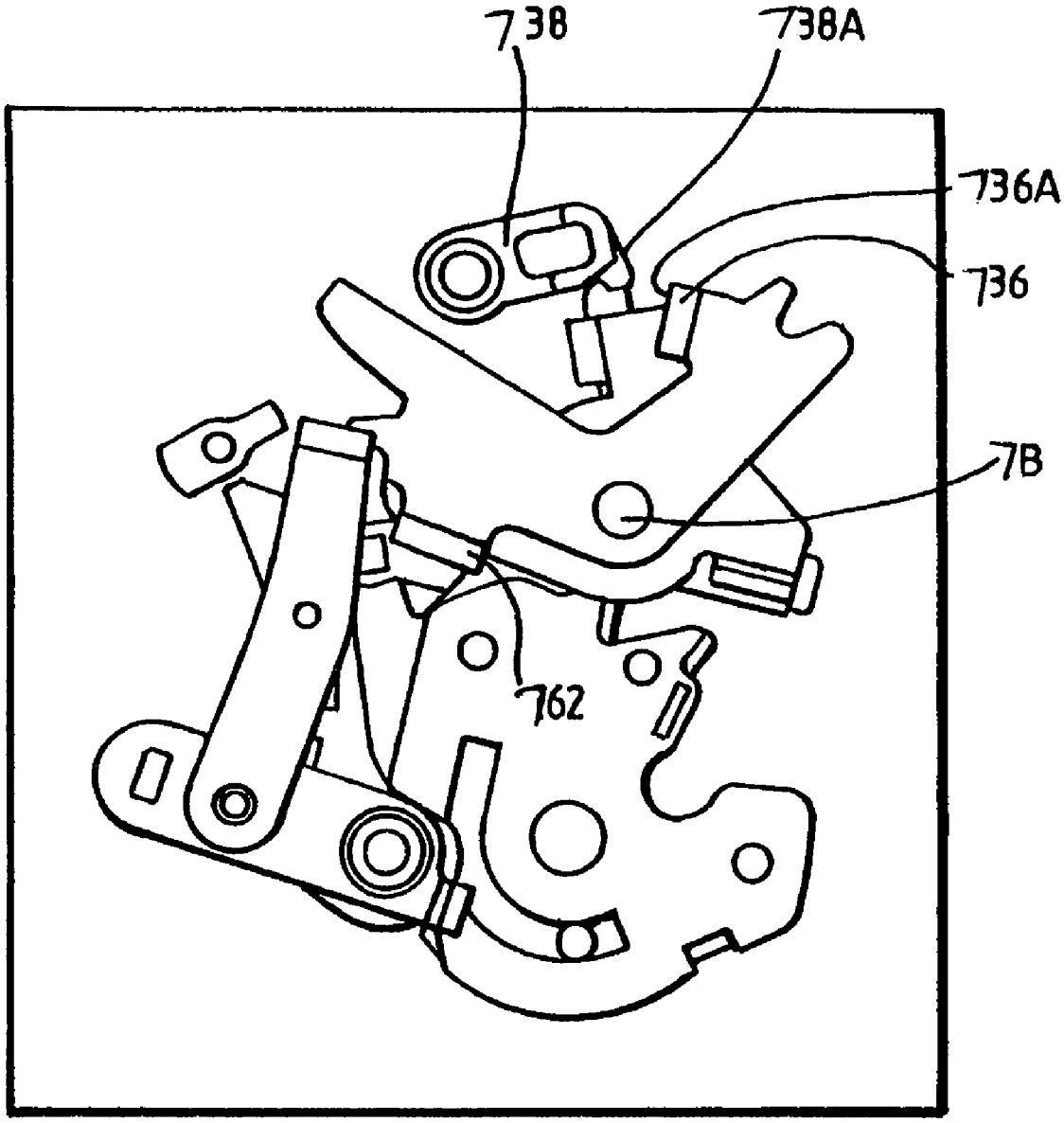
Figure 37:
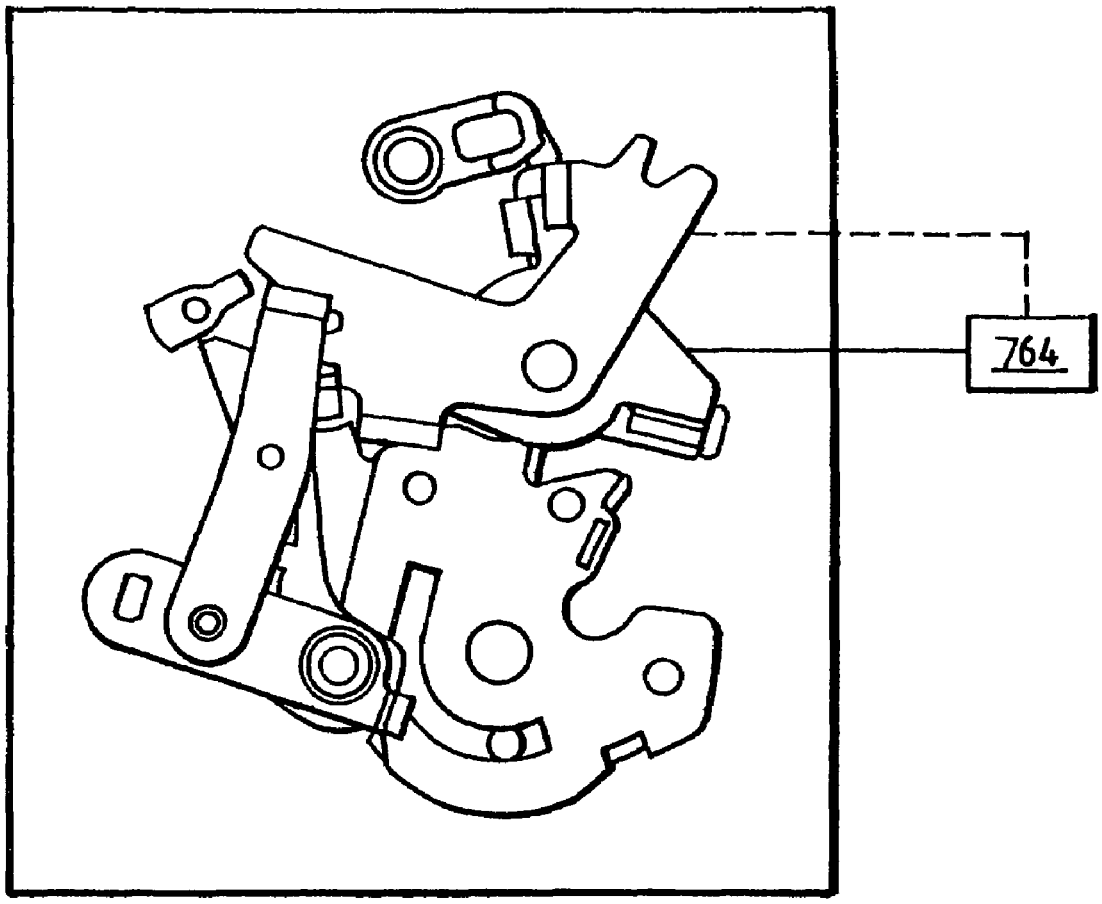
Figure 38:
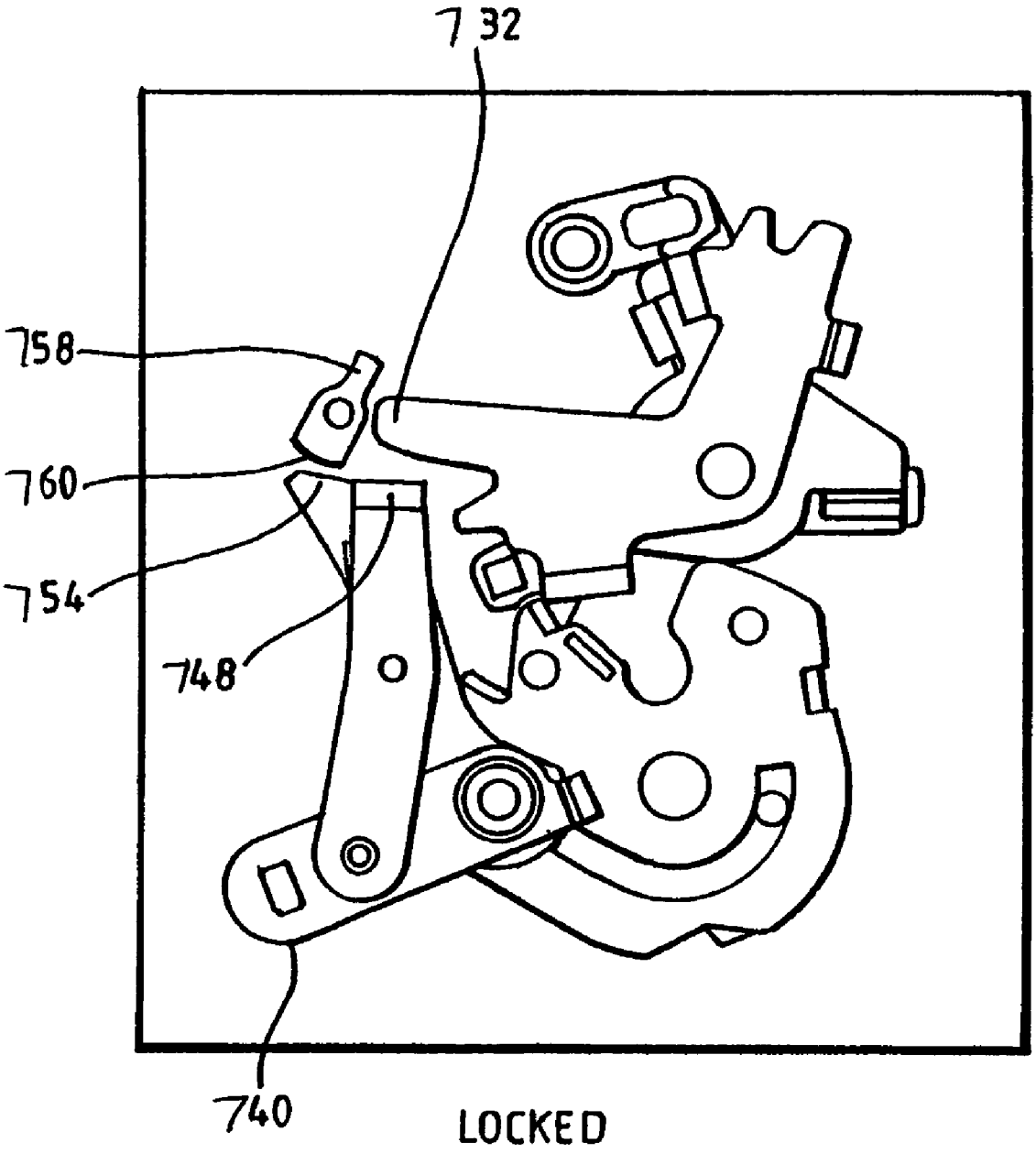
Figure 39:
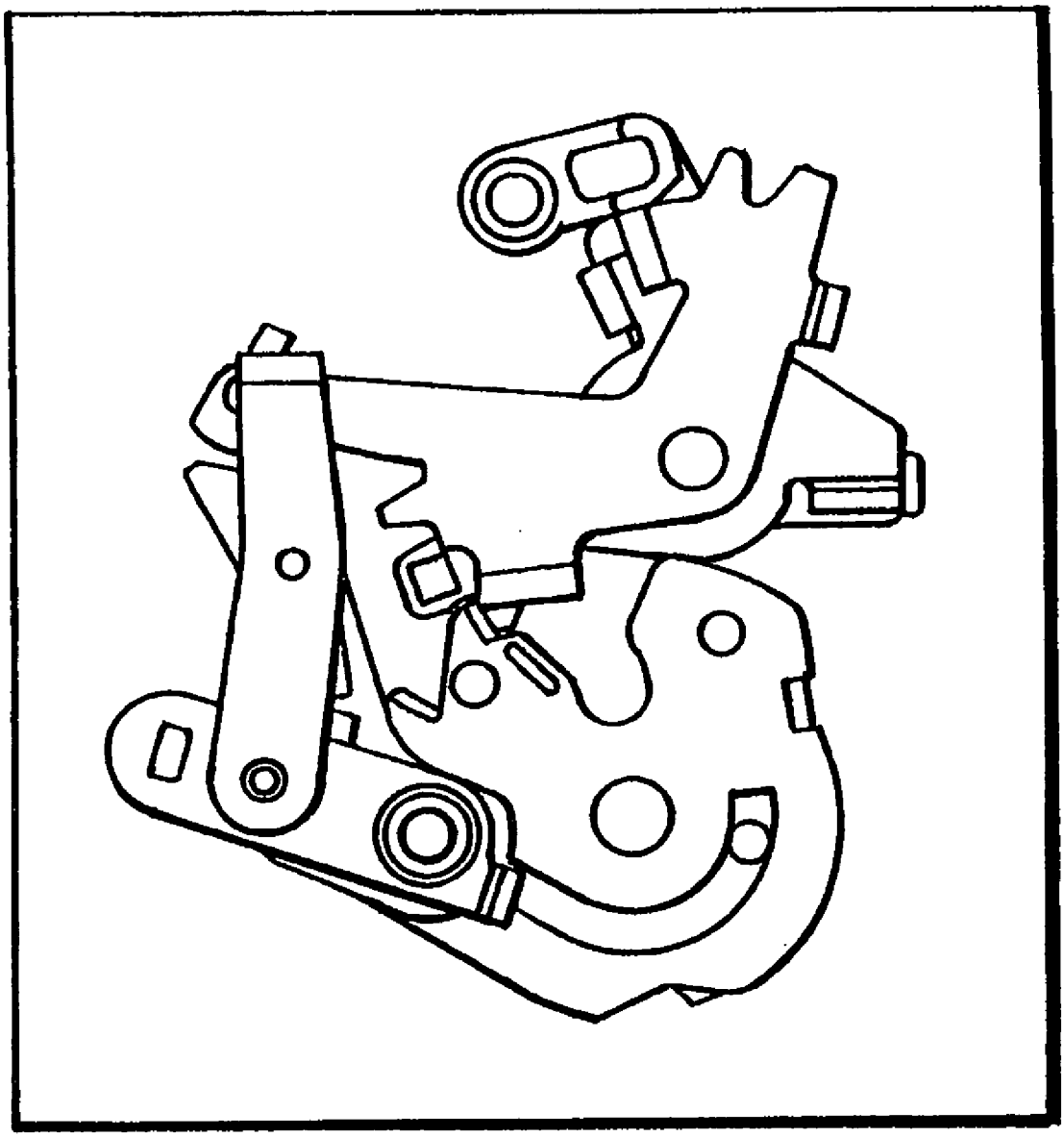
FIG. 39 is a view of the embodiment of the latch arrangement of FIG. 32 shown in a locked condition with the outside handle pulled.

FIG. 31 shows a further latch arrangement 610, similar to the latch arrangement 510, with components that fulfill substantially the same function labelled 100 greater. FIG. 31 shows the latch arrangement 610 in a latched condition, similar to the condition of the latch arrangement 510 shown in FIG. 21. In this case, the only difference between the latch arrangement 610 and the latch arrangement 510 is that latch arrangement 610 does not include a lock toggle 558. Thus, the latch arrangement 610 can be power unlatched or manually unlatched (when its power actuator fails) in a similar manner to latch arrangement 510. However, the latch arrangement 610 cannot be locked.

The latch arrangement 610 is in an unlocked latched first condition as shown in FIG. 31 by virtue of the fact that the latch arrangement 610 cannot be locked.

In a further embodiment, the actuator associated with the latch arrangement 610 can be deleted to provide a non power operable latch arrangement which cannot be locked. In a further embodiment of a non lockable latch, the lock link 652 and the link 650 of the latch arrangement 610 can be deleted and replaced by a bias member, such as a spring, which lightly biases the ratchet lever 546 in a clockwise direction to ensure engagement of the ratchet abutment 648 with appropriate ratchet teeth 632 and 634.

In this embodiment, the ratchet teeth 632 and 634 and the ratchet abutment 648 are in substantially permanent operable engagement, and hence the latch arrangement 610 cannot be locked by virtue of disengagement of the ratchet teeth 632 and 634 and the ratchet abutment 648. Though in yet further embodiments, the latch arrangement 610 could alternatively be locked by virtue of a block mechanism or a free wheel type mechanism positioned somewhere in the transmission path between the outside door handle and the first pawl 620.

FIGS. 32 to 38 show a further embodiment of a latch arrangement 710 wherein features which perform substantially the same function as in the latch arrangement 510 have been labelled 200 greater. Only the toggle 758 of the actuator according to the present invention has been shown for clarity. The pivots 2E, 2D and 2H as shown in FIG. 33A are the functional equivalents of the pivots E, D and H of the latch arrangement 510.

Figure 40:
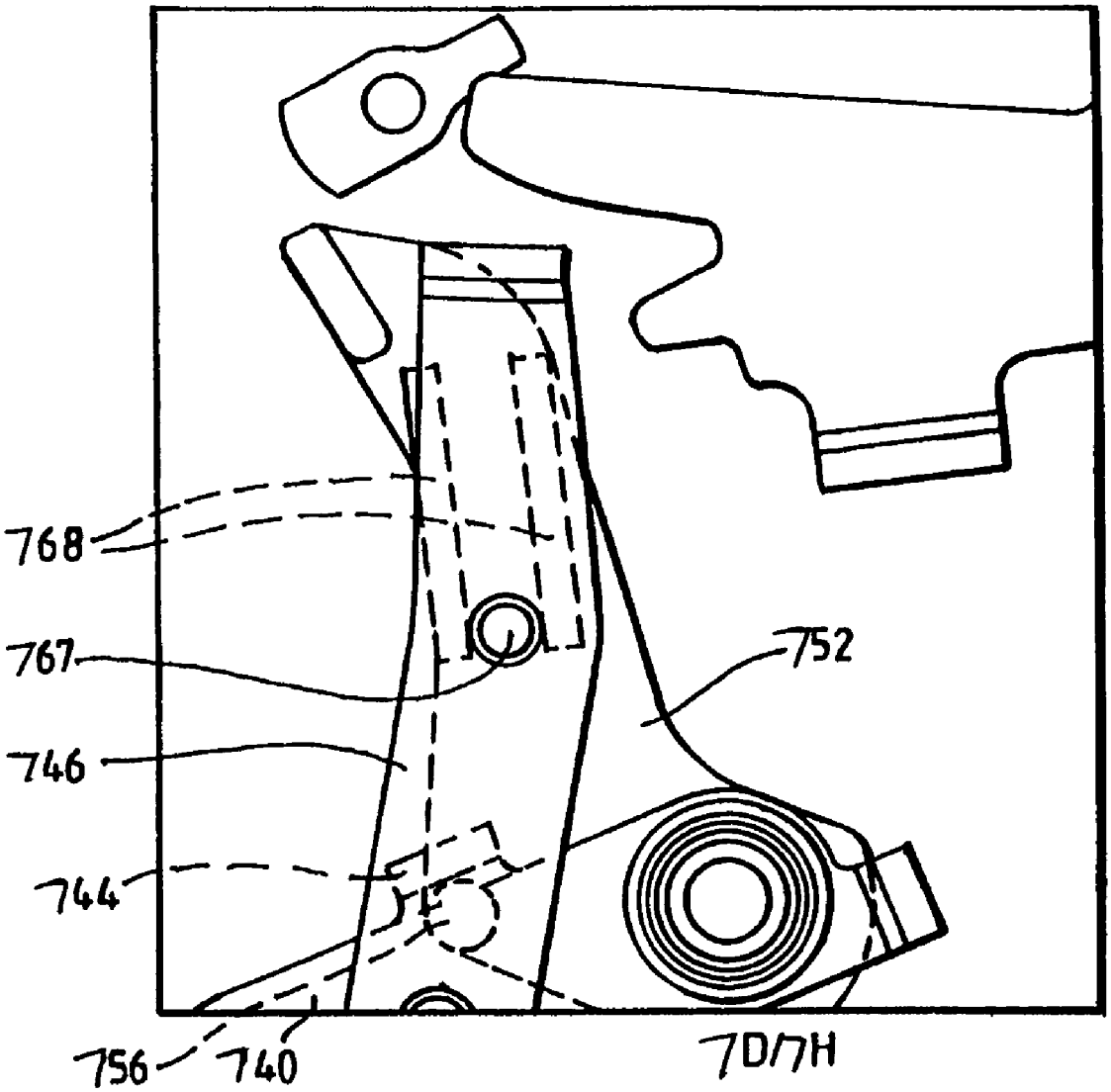
FIG. 40 is a close up view of part of the latch arrangement of FIG. 21A.

FIG. 40 shows that the lock link 652 is pivotally mounted at the pivot 2H, which is coincident with the pivot 2D about which the outside release lever 740 pivots. Furthermore, a pin 767 on the ratchet lever 746 projects between a slot formed by guides 768 of the lock link 752. The pin and slot arrangement replaces the link 550 of the latch arrangement 510.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. An actuator comprising:

a magnetic field generator, wherein the magnetic field generator is a single permanent magnet that is pivotally mounted about a pivot, and a north pole of the single permanent magnet and a south pole of the single permanent magnet are on opposing sides of the pivot; and an electromagnetic coil arrangement moveable relative to the magnetic field generator to define a first position of the actuator and a second position of the actuator, wherein the electromagnetic coil arrangement includes a frame and a magnetic core, wherein, when the actuator is in the first position, a pulse of current through the electromagnetic coil arrangement produces a region of magnetic field that repels the magnetic field generator from the first position of the actuator and attracts the magnetic field generator towards the second position of the actuator to move the actuator to the second position, wherein the single permanent magnet has the first position wherein one of the north pole and the south pole is proximate the frame and remote from the magnetic core and the other of the north pole and the south pole is remote from both the frame and the magnetic core, and wherein the single permanent magnet has the second position wherein the one of the north pole and the south pole is proximate the magnetic core and remote from the frame and the other of the north pole and the south pole is remote from both the magnetic core and the frame.

2. The actuator as defined in claim 1, wherein the the frame has a free end and the magnetic core has core ends and a side, and the frame is connected to one of the core ends of the magnetic core and extends along the side of the magnetic core, and the free end of the frame is spaced from the other of the core ends to provide the region of magnetic field.

3. The actuator as defined in claim 1, wherein the electromagnetic coil arrangement includes an end, and the region of magnetic field is located at the end of the electromagnetic coil arrangement.

4. The actuator as defined in claim 3, wherein the electromagnetic coil arrangement includes a central region and an outer region, and the region of magnetic field is located between the central region and the outer region.

5. The actuator as defined in claim 4, wherein the region of magnetic field is positioned over a limited circumferential extent of the electromagnetic coil arrangement.

6. The actuator as defined in claim 1, wherein a first air gap is provided between the electromagnetic coil arrangement and the magnetic field generator when the actuator is in the first position and a second air gap is provided between the electromagnetic coil arrangement and the magnetic field generator when the actuator is in the second position, wherein a size of the first air gap is greater than 1 mm.

7. The actuator as defined in claim 6, wherein a size of the second air gap is greater than 0.5 mm.

8. The actuator as defined in claim 1, wherein the actuator provides security functions on a vehicle.

9. The actuator as defined in claim 1, wherein a first air gap is provided between the electromagnetic coil arrangement and the magnetic field generator when the actuator is in the first position and a second air gap is provided between the electromagnetic coil arrangement and the magnetic field generator when the actuator is in the second position, wherein a size of the first air gap is less than 4 mm.

10. The actuator as defined in claim 9, wherein a size of the second air gap is less than 4 mm.

11. The actuator as defined in claim 1, wherein the north pole, the south pole and the pivot are aligned along a straight line, and the pivot is located between the north pole and the south pole.

* * * * *